US009217973B2

(12) United States Patent
Yamamoto

(10) Patent No.: US 9,217,973 B2
(45) Date of Patent: Dec. 22, 2015

(54) IMAGE HEATING APPARATUS

(75) Inventor: Naoyuki Yamamoto, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 1017 days.

(21) Appl. No.: 12/906,406

(22) Filed: Oct. 18, 2010

(65) Prior Publication Data

US 2011/0091230 A1 Apr. 21, 2011

(30) Foreign Application Priority Data

Oct. 19, 2009 (JP) ..... 2009-240323

(51) Int. Cl.

| | |
|---|---|
| ***H05B 6/14*** | (2006.01) |
| ***H05B 6/06*** | (2006.01) |
| ***H05B 1/00*** | (2006.01) |
| ***G03G 15/20*** | (2006.01) |

(52) U.S. Cl.

CPC .... *G03G 15/2064* (2013.01); *G03G 2215/2035* (2013.01)

(58) Field of Classification Search

CPC ..... G03G 15/2064; G03G 15/2039; G03G 15/2053; G03G 15/2057; G03G 15/2042; G03G 2215/2035; G03G 2215/2032; G03G 2215/2038; H05B 6/145

USPC ..... 219/619, 667, 665, 650, 216, 388, 469, 219/672, 676; 399/69, 328–338, 88

See application file for complete search history.

(56) References Cited

U.S. PATENT DOCUMENTS

| | | | | |
|---|---|---|---|---|
| 6,687,481 | B2 * | 2/2004 | Watanabe et al. | 399/328 |
| 7,196,296 | B2 | 3/2007 | Yamamoto | |
| 7,205,514 | B2 | 4/2007 | Suzuki et al. | |
| 7,238,924 | B2 | 7/2007 | Kondo et al. | |
| 7,268,326 | B2 | 9/2007 | Yamamoto et al. | |
| 7,268,327 | B2 | 9/2007 | Yamamoto et al. | |
| 2005/0173415 | A1 * | 8/2005 | Yamamoto et al. | 219/619 |
| 2006/0081614 | A1 * | 4/2006 | Nami et al. | 219/619 |
| 2006/0086722 | A1 * | 4/2006 | Takematsu et al. | 219/619 |
| 2006/0086723 | A1 * | 4/2006 | Nagahira | 219/619 |
| 2006/0088327 | A1 | 4/2006 | Nakase et al. | |
| 2006/0157475 | A1 * | 7/2006 | Nishihara et al. | 219/619 |

(Continued)

FOREIGN PATENT DOCUMENTS

| | | |
|---|---|---|
| JP | 2000-39797 | 2/2000 |
| JP | 2001-125407 | 5/2001 |

(Continued)

*Primary Examiner* — Hung D Nguyen

(74) *Attorney, Agent, or Firm* — Fitzpatrick, Cella, Harper & Scinto

(57) ABSTRACT

An apparatus includes: a coil; a heater, including an electro-conductive layer of magnetism-adjusted alloy whose Curie temperature is lower than apparatus's durable temperature; a magnetic core directing a magnetic flux generated by the coil to the heater; a controller controlling electric power supply to the coil so that a temperature of the heater is a temperature sufficient to heat an image on a sheet, the Curie temperature being higher than the image heating temperature; and a blocker of non-magnetic metal having a resistivity smaller than that of the magnetism-adjusted alloy. The blocker opposes the coil with the heater therebetween. The blocker is in a first region where the coil opposes the heater, and a length L2 of the first region and a length L3 of a second region where the heater and blocker oppose each other, both regions measured in a rotational direction of the heater, satisfy L2/2≤L3.

12 Claims, 15 Drawing Sheets

(56) References Cited

U.S. PATENT DOCUMENTS

| | | | |
|---|---|---|---|
| 2007/0127959 | A1 | 6/2007 | Tatematsu et al. |
| 2008/0124111 | A1 | 5/2008 | Baba et al. |

FOREIGN PATENT DOCUMENTS

| | | |
|---|---|---|
| JP | 2007-156065 | 6/2007 |
| JP | 2008-152247 | 7/2008 |

* cited by examiner

IMAGE HEATING APPARATUS

FIELD OF THE INVENTION AND RELATED ART

The present invention relates to an image heating apparatus of the magnetic-induction type (electromagnetic-induction-heating type), which is used by an image forming apparatus, such as a copying machine, a printer, a facsimile machine, and a multi-functional image forming apparatus capable of performing two or more functions of the preceding examples of an image forming apparatus, to heat an image on a sheet of a recording medium. As examples of an image heating apparatus, a fixing apparatus for thermally fixing an unfixed image on a sheet of a recording medium, a glossiness-increasing apparatus for increasing the glossiness of a fixed image on a sheet of a recording medium by reheating the image, and the like apparatuses can be listed.

An electrophotographic image forming apparatus has an image heating apparatus for heating an unfixed toner image on a sheet of a recording medium to fix the unfixed toner image to the sheet of a recording medium. An image heating apparatus of this type has a rotatable heating member for thermally melting the toner particles in the unfixed toner image on the sheet of the recording medium, and a pressing member for holding the sheet of the recording medium against the rotational heating member by being kept pressed against the rotational heating member. The rotational heating member is in the form of a heat roller, an endless belt, or the like. It is directly or indirectly heated, and also, internally or externally, heated by a heat generating member. As examples of a heat generating member, a halogen heater, a heating apparatus based on electrical resistance, and the like can be listed. In recent years, it has come to be emphasized to reduce an image forming apparatus in energy consumption while improving it in usability (improvement in printing speed, reduction in warm-up time). Thus, it has been proposed to employ an image heating apparatus of the induction-heating type, because an image heating apparatus of the induction-heating type is high in heat generation efficiency. An image heating apparatus of this type directly heats its rotational heating member itself. More specifically, it causes high frequency electric current to flow through its exciter coil, which is for inducing a magnetic field to induce eddy current in the rotational heating member so that Joule heat is generated in the rotational heating member by the interaction between the eddy current and the surface resistance of the rotational heating member itself. The heating apparatus of this type is very high in heat generation efficiency, and therefore, can substantially reduce an image forming apparatus (heating apparatus) in warm-up time. Another method for effectively reducing the energy consumption of an image forming apparatus n as well as its warm-up time is to reduce the thermal capacity of the rotational heating member. However, a rotational heating member which is small in thermal capacity suffers from the problem that as a substantial number of small sheets of a recording medium are continuously conveyed through a fixing apparatus, the rotational heating member of the fixing apparatus excessively increases in temperature across its out-of-sheet-path-portions, that is, the portions which are outside the recording-medium path in terms of the lengthwise direction of the heating member. One of the countermeasures for this problem is the countermeasure proposed in Japanese Laid-open Patent Application 2000-39797. According to this application, a roller made of magnetic alloy, which has been adjusted in Curie temperature so that its Curie temperature coincides with the temperature level for fixation, is used as the rotational heating member of an image heating apparatus of the induction-heating type. On the other hand, generally, as a magnetic substance increases in temperature beyond its Curie point, which is specific to the substance, the magnetism of the substance decreases, decreasing thereby in magnetic flux density. As the magnetic substance decreases in the magnetic flux density, its surface resistance decreases, and therefore, the amount of heat generated in the substance by magnetic induction decreases. Thus, it is desired that a magnetic substance, the Curie temperature of which is equal to a preset fixation level is used as the material for the rotational heating member, because a rotational heating member formed of the above-described magnetic substance stabilizes in temperature as its temperature becomes no less than a level which is determined by the relationship between the amount of the heat radiation from the rotational heating member and the amount of heat generated in the rotational heating member when its temperature is above its Curie temperature. This property of a magnetic substance can be utilized to improve a rotational heating member in terms of its unwanted temperature increase across its portions outside the recording-medium path (out-of-sheet-path portions). Japanese Laid-open Patent Application 2001-125407 discloses a heating apparatus of the induction type which is higher in the efficiency of its heating member made of the Curie-temperature-adjusted alloy. According to this patent application, the heating apparatus is provided with an electrically conductive member (magnetic flux blocking member), which is positioned in the adjacencies of the heating member formed of the Curie-temperature-adjusted alloy.

However, if a heating apparatus of the magnetic-induction type is structured so that a stationary magnetic flux blocking member, which is long enough in terms of the lengthwise direction of the rotational heating member of the heating apparatus to extend from one end of the range across which the rotational heating member faces the exciter coil of the apparatus, to the other, is positioned in the adjacencies of the rotational heating member, the following problem occurs. That is, the thermal capacity and positioning of the magnetic flux blocking member affects the length of the startup time (warm-up time); it is likely to increase the startup time. On the other hand, the effort to reduce an image forming apparatus (heating apparatus) in startup time may interfere with the measure for preventing the out-of-sheet-path-portions of the rotational heating member from unnecessarily increasing in temperature.

SUMMARY OF THE INVENTION

Thus, the primary object of the present invention is to prevent the rotational heating member of a heating apparatus of the magnetic-induction type, from undesirably increasing in temperature across its out-of-sheet-path portions.

According to an aspect of the present invention, there is provided an image heating apparatus comprising: a coil; an image heating member, including an electroconductive layer of magnetism-adjusted alloy having a Curie temperature lower than a durable temperature of the image heating apparatus, for heating an image on a recording material; a magnetic core for directing a magnetic flux generated by the coil to the image heating member; control means for controlling electric power supply to the coil so that a temperature of the image heating member is an image heating temperature sufficient to heat the image on the recording material, wherein the Curie temperature is higher than the image heating temperature; and a magnetic flux blocking member of non-magnetic metal having a resistivity smaller than that of the magnetism-adjusted alloy. The magnetic flux blocking member is opposed to the coil with the image heating member therebetween, wherein the magnetic flux blocking member is in a first opposing region in which the coil is opposed to the image heating member, and a length L2 of the first opposing region measured in a rotational direction of the image heating member, and a length L3, measured in the rotational direction of the image heating member, of a second opposing region in which the magnetic flux blocking member and the image heating member are opposed each other, satisfy $L2/2 \leq L3$.

These and other objects, features, and advantages of the present invention will become more apparent upon consideration of the following description of the preferred embodiments of the present invention, taken in conjunction with the accompanying drawings.

BRIEF DESCRIPTION OF THE DRAWINGS

FIG. 7(*b*) is a graph which shows the relationship between the size of the magnetic flux blocking member, and the temperature of the out-of-sheet-path-portions of the heat roller.

FIG. 11(*b*) is a graph which shows the relationship between the size of the magnetic flux blocking member, and the temperature of the out-of-sheet-path-portions of the heat roller, in the fifth embodiment.

DETAILED DESCRIPTION OF THE PREFERRED EMBODIMENTS

Embodiment 1

(1) Example of Image Forming Apparatus

Figure 1A:
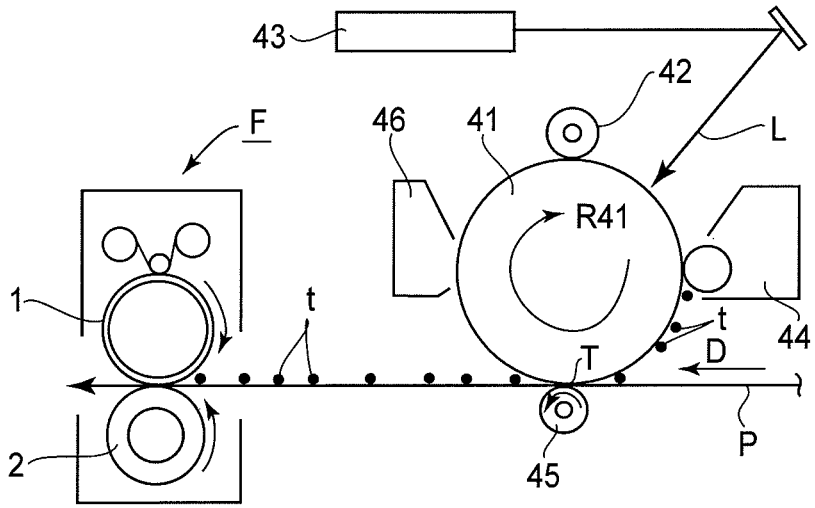
FIG. 1A is a schematic sectional view of the image forming apparatus in the first preferred embodiment of the present invention, and depicts the general structure of the apparatus.

FIG. 1A is a schematic sectional view of an example of an image forming apparatus which has a fixing apparatus F which is an image heating apparatus of the induction-heating type in accordance with the present invention. This image forming apparatus is a digital electrophotographic image forming apparatus (a copying machine, a printer, a facsimile machine, a multi-functional apparatus capable of performing functions of preceding apparatus, etc.), and uses a laser-based scanning means as its exposing means. Designated by a reference numeral 41 is an electrophotographic photosensitive member as an image bearing member. The photosensitive member is in the form of a rotatable drum (which hereafter will be referred to as drum 41). It is rotated in the clockwise direction indicated by an arrow mark R41 at a preset peripheral velocity. Designated by reference numeral 42 is a first charging device (charge roller of contact type). As the first charging device is rotated, the peripheral surface of the drum 41 is uniformly charged to a preset level (dark potential level, which in this embodiment is negative). Designated by reference numeral 43 is a laser beam scanner as a drum exposing means, which scans (exposes) the uniformly charged portion of the peripheral surface of the drum 41, with a beam L of laser light which it outputs while modulating the beam L in response to the digital image formation signals inputted into the laser beam scanner 43 from a host apparatus (unshown), such as an image reading apparatus, a computer, a facsimile, and like. As the uniformly charged portion of the peripheral surface of the drum 41 is exposed, the exposed points of the uniformly charged portion of the peripheral surface of the drum 41 decrease in potential level to light potential level V1. Thus, an electrostatic latent image, which reflects the image formation signals, is formed on the peripheral surface of the drum 41. The electrostatic latent image is developed by a developing device 44. More specifically, negatively charged toner adheres to the points of the charged portion of the peripheral surface of the drum 41, which have decreased in potential to V1 (light potential level), developing thereby in reverse the electrostatic latent image into a visible image t (image made of toner). Meanwhile, a sheet P of a recording medium (which hereafter will be referred to as recording sheet P) is fed into the main assembly of the image forming apparatus from the sheet feeding portion (unshown) of the apparatus, and is delivered, with a proper timing, to the transfer nip T, which is the area of contact between the transfer roller 45 (toner image transferring member) to which transfer bias is being applied, and the drum 41, and is conveyed through the nip T. As the recording sheet P is conveyed through the nip T, the toner image t on the peripheral surface of the drum 41 is transferred onto the recording sheet P as if it is peeled away from the drum 41, starting at the leading edge of the toner image t. As the recording sheet P is conveyed out of the nip T, it is introduced into the fixing apparatus F, through which it is conveyed. As it is conveyed through the fixing apparatus F, it and the unfixed toner image thereon are subjected to heat and pressure, whereby the unfixed toner image t becomes fixed to the recording sheet P. Thereafter, the recording sheet P is discharged as a finished print (copy) from the image forming apparatus. After the separation of the recording sheet P from the peripheral surface of the drum 41, the peripheral surface of the drum 41 is cleaned by the cleaning apparatus 46; substances such as toner particles remaining on the peripheral surface of the drum 41 are removed by the cleaning apparatus 46 so that the drum 41 can be repeatedly used for image formation.

(2) Fixing Apparatus F

Figure 1B:
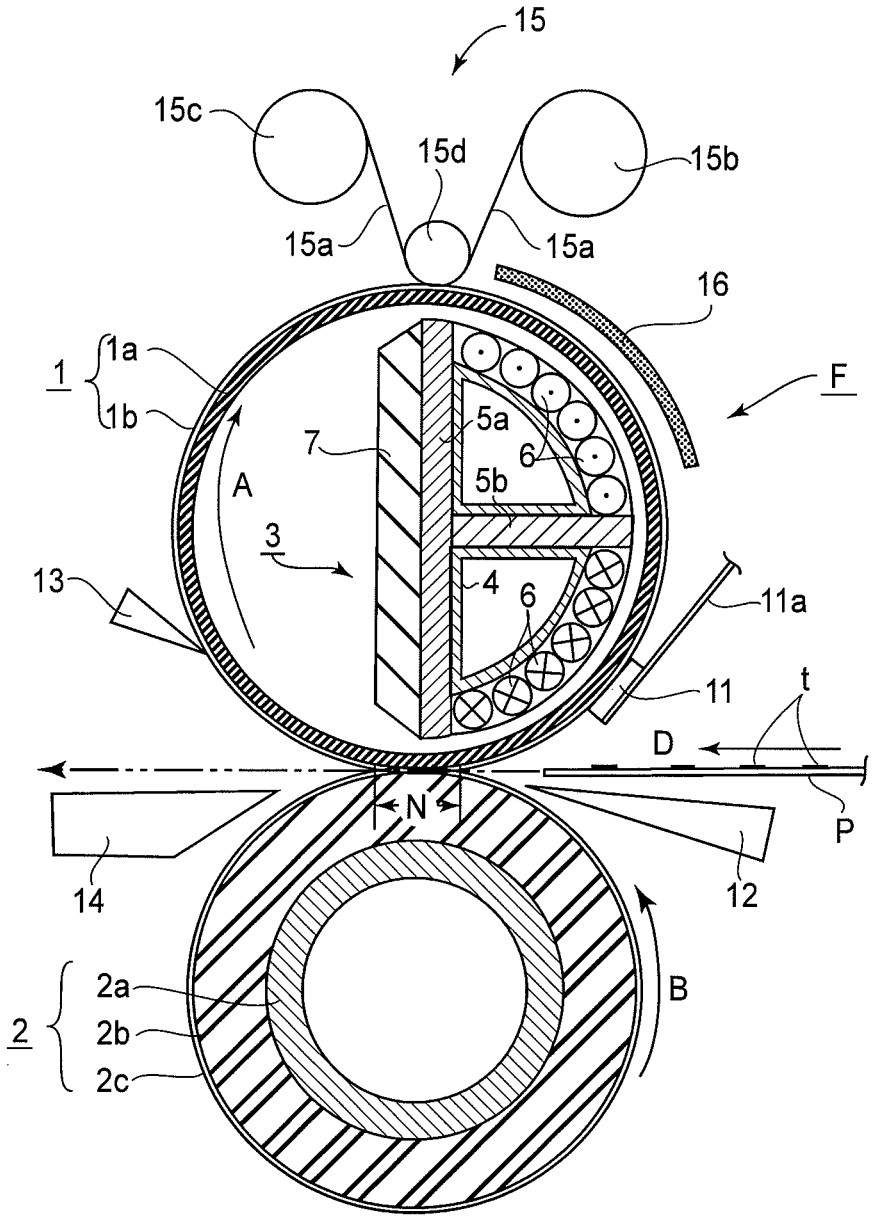
FIG. 1B is a schematic cross-sectional view of the image heating apparatus (fixing apparatus) in the first embodiment.
Figure 2A:
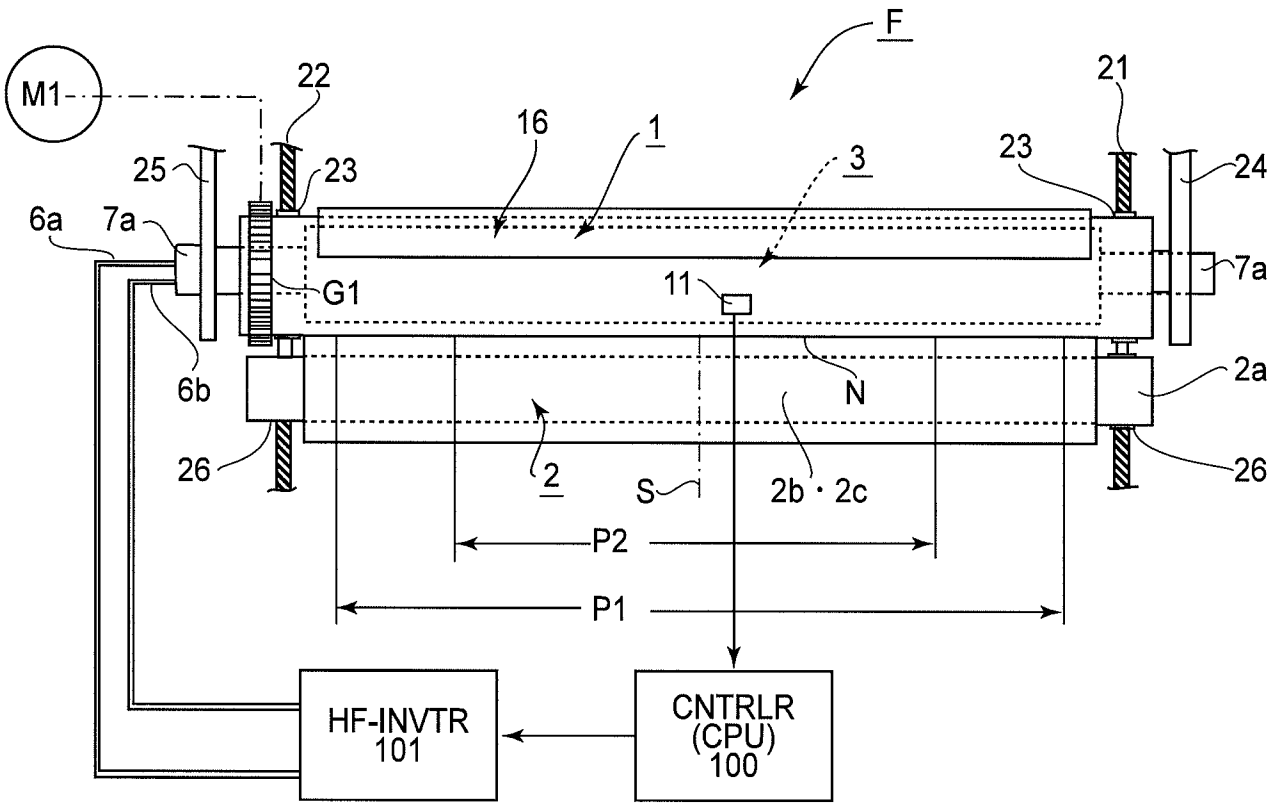
FIG. 2A is a schematic front view of the image heating apparatus in the first embodiment.
Figure 2B:
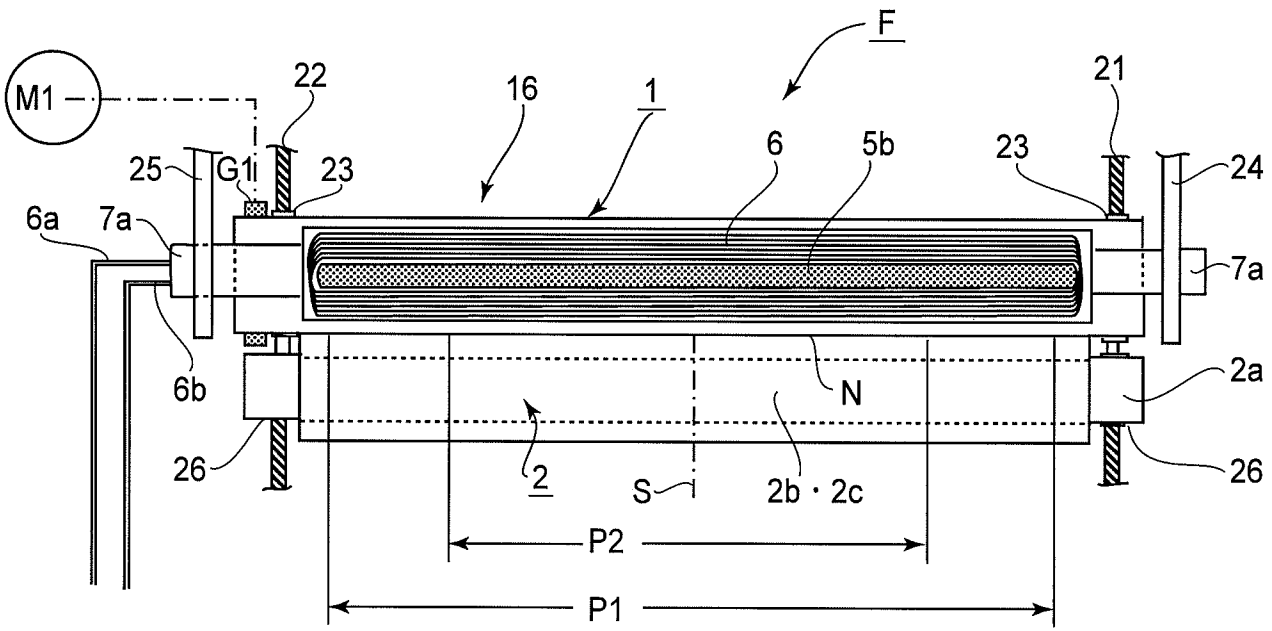
FIG. 2B is a schematic cross-sectional view of the same apparatus.

FIG. 1B is an enlarged schematic cross-sectional view of the essential portions of the fixing apparatus F. FIG. 2A is a front view of the essential portions of the fixing apparatus F, and FIG. 2B is a schematic vertical sectional view of the essential portions of the fixing apparatus F, at the vertical plane which coincides with the axial line of the heating member (heat roller) of the apparatus F. The "front surface" of the fixing apparatus F is the surface of the fixing apparatus F, which faces the direction from which the recording sheet P is introduced into the apparatus F. This fixing apparatus is a heating apparatus of the induction-heat-generation type, and employs a heat roller in which heat is generated by magnetic induction. It has a coil 6 (exciter coil) and a high frequency invertor 101 (high frequency electric power source), which is an electric power source for causing high frequency electric current to flow through the coil 6. It has also a heat roller 1 (fixation roller) as an image heating member. It generates heat therein as it is exposed to the magnetic flux H (FIG. 4A) generated by the coil 6. At least a part of the heat roller has an electrically conductive layer which is formed of a magnetic alloy, the Curie temperature of which is the same as the aforementioned preset temperature level for fixation. The fixing apparatus F has also an elastic pressure roller 2 as a pressure applying member which is for forming a nip N (fixation nip) between itself and the roller 1. Further, the fixing apparatus F has a thermistor as a temperature detecting means for detecting the temperature of the roller 1, and a control circuit 100 (CPU) as a controlling means which controls the electric power supply from the inverter 101 to the coil 6, so that the temperature of the roller 1 converges to the image heating level Tf (fixation temperature) in response to the output of the thermistor 11. Further, the fixing apparatus F has a magnetic flux blocking member 16 (magnetism blocking member), at least a part of which is formed of a nonmagnetic metal, which is smaller in electrical resistance than the Curie-temperature-adjusted-alloy. In essence, the fixing apparatus F is an apparatus that heats a sheet P of recording medium, on which an unfixed toner image t is present, while conveying the recording sheet P through its nip N. The above-mentioned preset level to which the Curie temperature Tc is set is higher than the preset image heating level Tf, and is lower than the highest temperature level Tm which the fixing apparatus F can withstand. The temperature level Tm is a temperature level above which some components of the apparatus F drastically increase in thermal damage.

Figure 3A:
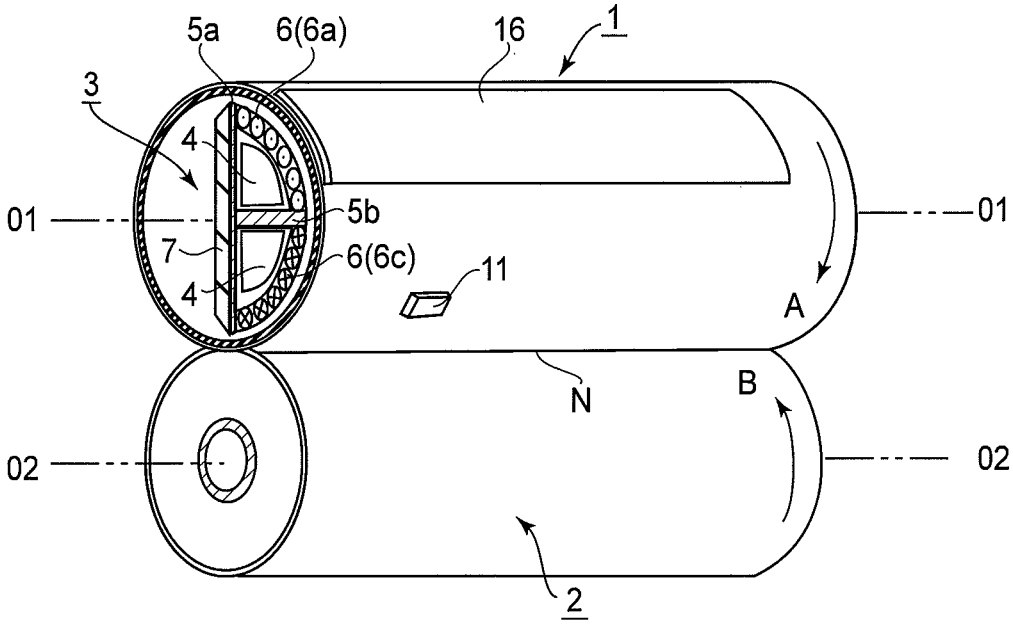
FIG. 3A is a combination of a schematic perspective view of the heat roller and pressure roller of the image heating apparatus in the first embodiment, and a schematic perspective sectional view of the two rollers.

The roller 1 is cylindrical, and is 40 mm in external diameter, 1.0 mm in wall thickness, and 340 mm in length. It has a cylindrical metallic core 1*a* made of an electrically conductive substance, more specifically, a metallic alloy formed of a combination of iron, nickel, chrome, etc., and adjusted in magnetism (adjusted in Curie temperature to a preset level). The metallic core 1*a* is covered with a surface layer 1*b* for improving the roller 1 in parting performance (toner releasing performance). The surface layer 1*b* is formed of a fluorinated resin such as PFA or PTFE, and is 30 μm in thickness. In this embodiment, the image heating temperature level Tf is set to 190° C., and the temperature level Tm is set to 230° C. The Curie temperature level Tc is set to 200° C., which is higher than the image heating temperature level Tf (190° C.), but lower than the maximum temperature level Tm (230° C.). Incidentally, a heat resistant elastic layer may be placed between the metallic core 1*a* and surface layer 1*b* to improve the fixing apparatus F in the fixation of a high quality image, such as a multicolor image. The roller 1 is rotatably supported by the front and rear plates 21 and 22, respectively, at their lengthwise end portions, with the placement of a pair of bearings 23 between the lengthwise ends of the roller 1 and the front and rear plates 21 and 22, one for one. The front and rear plates 21 and 22 are parts of the main frame of the image forming apparatus. Referring to FIG. 3A, a line O1-O1 indicates the rotational axis of the roller 1, or the direction of the rotational axis of the roller 1. There is a coil assembly 3 in the hollow of the roller 1. The coil assembly 3 is a magnetic flux generating means (magnetic field generating means) that has the coil 6 for generating a high frequency magnetic field for inducing electric current (eddy current) in the metallic core 1*a* to generate Joule heat in the metallic core 1*a*.

The roller 2 is an elastic roller, and is 38 mm in external diameter and 330 mm in length. It comprises: a metallic core 2*a*; a heat resistant elastic layer 2*b* which is coaxial and integrally formed with the metallic core 2*a* in a manner to wrap the metallic core 2*a*; and a surface layer 2*c* which covers the entirety of the peripheral surface of the elastic layer 2*b*. The metallic core 2*a* is a piece of metallic pipe, which is 23 mm in external diameter and 330 mm in length. The elastic layer 2*b* is formed of a heat resistant elastic substance, and is 5 mm in thickness. The surface layer 2*c* is a thin layer formed of a fluorinated resin such as PFA and PTFE, and is 30 μm in thickness. The roller 2 is under the roller 1, and is parallel to the roller 1. It is rotatably held by the aforementioned front and rear plates 21 and 22, between the two plates 21 and 22, at its front and rear end portions, with the presence of a pair of bearings 26 between the front and rear end portions and the front and rear plates 21 and 22, respectively. Referring to FIG. 3A, a line O2-O2 is a rotational axis of the roller 2, or the direction of the rotational axis of the roller 2. The rollers 1 and 2 are kept pressed against each other by a preset amount of pressure applied by an unshown pressure applying mechanism so that the elastic layer 2*b* remains compressed by the preset amount of pressure, creating a nip N between the two rollers 1 and 2. The nip N is roughly 5 mm in width in terms of the recording-sheet conveyance direction D. It is where the recording sheet P, on which an unfixed toner image t is present, is conveyed, while remaining pinched by the two rollers 1 and 2, so that the unfixed toner image t is thermally fixed to the recording sheet P. Incidentally, the "lengthwise direction" of the structural components of the image heating apparatus in accordance with the present invention is the direction perpendicular to the lengthwise edges of the nip N, that is, the direction perpendicular to the recording-sheet conveyance direction D. Further, their center and end portions are their center and end portions in terms of their "lengthwise direction".

Figure 3C:
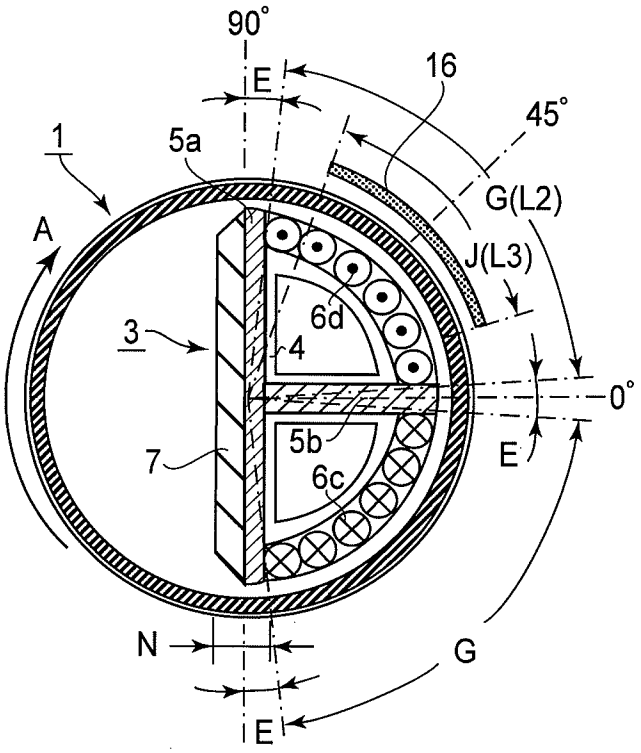
FIG. 3C is a schematic cross-sectional view of the heat roller in the first embodiment.
Figure 3B:
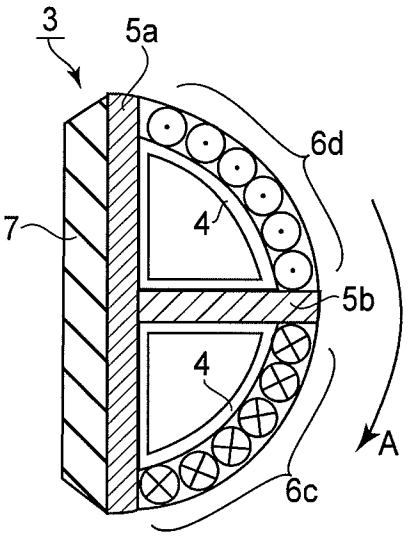
FIG. 3B is a schematic cross-sectional view of the coil assembly in the first embodiment.

The coil assembly 3 has a bobbin 4, a magnetic core 5 (combination of portions 5*a* and 5*b*) (cores made of magnetic substance), a coil 6, an electrically insulative stay 7, etc. The core 5 is held by the bobbin 4. The coil 6 is formed by winding a piece of electric wire (Litz wire) around the bobbin 4. The bobbin 4, the core 5, and the coil 6 are integrated as a unit, which is immovably supported by the stay 7. The assembly 3 is in the cylindrical hollow of the roller 1. The assembly 3 is immovably attached to the front and rear assembly supporting members 24 and 25, by the lengthwise ends 7*a* and 7*a* of the stay 7 with the provision of a preset amount of gap between the inward surface of the roller 1 and the coil 6. The coil assembly 3 (integrated combination of bobbin 4, the core 5, and the coil 6) is within the roller 1, being positioned so that each of its lengthwise ends is on the inward side of the corresponding end opening of the roller 1. The core 5 is made of a substance such as ferrite and Permalloy, which is high is magnetic permeability and low in residual magnetic flux density. The core 5 is for guiding the magnetic flux generated by the coil 6, to the metallic core 1*a*. The core 5 in this embodiment is in the form of a letter T in cross-section. It is an integral combination of a side portion 5*a* of the core 5, which corresponds to the horizontal portion of a letter T, and a center portion 5*b* of the core 5, which corresponds to the vertical portion of a letter T. The coil 6 was made by winding multiple times a piece of Litz wire around the combination of the bobbin 4 and the center core 5*a* so that the coil 6 would be formed in the pattern of a long and narrow boat which perfectly fits around the bobbin 4, and the lengthwise direction of which is parallel to the lengthwise direction of the combination of the bobbin 4 and core 5. Thus, the lengthwise direction of the core 6 is parallel to the lengthwise direction of the roller 1, that is, the direction parallel to the direction of the rotational axis of the roller 1, which is indicated by the line O1-O1 in FIG. 3A. Further, the coil 6 was formed so that its external contour coincides with the internal contour of the roller 1. Referring to FIG. 3B which is a schematic cross-sectional view of the assembly 3, the coil 6, the structure of which is as described above, has portions 6*c* and 6*d*, which are the bottom and top sides, respectively, of the coil 6 with the reference to the center portion 5*b* of the core 5. For convenience, the bottom and top sides 6*c* and 6*d* of the coil 6 will be referred to as the first and second coil portions, respectively, hereafter. The distance (gap) between the first coil portion 6*c* and the inward surface of the roller 1 is the same as the distance (gap) between the second coil portion 6*d* and the inward surface of the roller 1. Designated by reference characters 6*a* and 6*b* are two lead wires (electric power supply lines) of the coil 6, and are extended outward of the assembly 3 from the rearward end of the stay 7, being in connection with the invertor 101.

The invertor 101 has a switching element, which can be turned on and off with a preset frequency to cause electric current to flow through the coil 6 with the preset frequency. The invertor 101 in this embodiment outputs a preset amount of voltage (100 V), and the amount of electric power supplied to the coil 6 is set by controlling the amount of flowing electric current, and the length of time the switching element is kept turned on. The thermistor 11 is outside the roller 1, and is held by the apparatus main assembly, with the placement of a supporting member 11*a* between the thermistor 11 and the main frame. It detects the surface temperature of the roller 1. It may be of the contact type or non-contact type. The thermistor in this embodiment opposes the first portion 6*c* of the coil 6, with the presence of the wall of the roller 1 between the thermistor 11 and the first portion 6*c*, and is kept elastically pressed upon the peripheral surface of the roller 1 by the supporting member 11*a*, which is elastic. The roller temperature signal outputted by the thermistor 11 is inputted into the control circuit 100. Designated by a reference numeral 12 is a recording sheet guiding front plate. As the recording sheet P is conveyed from the image forming mechanism to the apparatus F, the recording sheet guiding front plate 12 guides the recording sheet P to the entrance of the nip N. Designated by reference numeral 13 is a recording sheet parting claw, which helps the recording sheet P separate from the roller 1 by preventing the recording sheet P from wrapping around the roller 1 as the recording sheet P comes out of the nip N. Designated by reference numeral 14 is a recording sheet guiding rear plate, which guides the recording sheet P toward the recording sheet outlet of the image forming apparatus as the recording sheet P comes out of the nip N and separates from the roller 1. The material for the bobbin 4, the stay 7, and the parting claw 13 is a heat resistance and electrically insulative engineered plastic. In the first embodiment, the apparatus F is engineered so that the highest temperature level Tm it can with stand is 230° C., based on the highest temperature level which this engineered plastic can withstand. Designated by a reference characters G1 is a drive gear, which is immovably fitted around the rear end portion of the roller 1. As driving force is transmitted to the gear G1 from a roller driving power source M1 through a mechanical power transmission system (unshown), the roller 1 rotates in the clockwise direction, which is indicated by an arrow mark A1, at a peripheral velocity of 300 mm/sec. The roller 2 is rotated in the counterclockwise direction indicated by an arrow mark B by the rotational force transmitted from the roller 1 by the friction between the two rollers 1 and 2 in the nip N. Designated by a reference numeral 15 is a roller cleaner, which comprises: a web supply shaft 15*b* which holds a roll of cleaning web 15*a*; a web take-up shaft 15*c*; and a roller 15*d* which keeps the portion of the web, which is between the shafts 15*b* and 15*c*, pressed upon the peripheral surface of the roller 1. Thus, the toner having transferred onto the peripheral surface of the roller 1 is wiped away by the portion of the web, which is in contact with the peripheral surface of the roller 1, to clean the peripheral surface of the roller 1. The web roll on the shaft 15*b* is intermittently unrolled from the shaft 15*b*, and is taken up by the shaft 15*c* so that the portion of the web, which is in contact with the roller 1, is intermittently replaced little by little with the upstream portion of the web 15*a*.

The magnetic flux blocking member 16 is supported by the supporting member (unshown), which is attached to the apparatus main assembly. It is outside the roller 1. In this embodiment, it faces toward the coil 6 in the roller 1, more specifically, the second portion 6*d* of the coil 6, with the presence of the wall of the roller 1 between the second portion 6*d* and magnetic flux blocking member 16. There is a preset amount of distance (gap) between the magnetic flux blocking member 16 and the peripheral surface of the roller 1; the magnetic flux blocking member 16 is not in contact with the roller 1. The magnetic flux blocking member 16 is smaller in resistivity than the metallic core 1*a* of the roller 1, the material of which is a magnetic metallic alloy that is preset in magnetism strength, and that generates heat as it is subjected to magnetic flux. As the material for the magnetic flux blocking member 16, a nonmagnetic metal such as copper, aluminum, and the like, is desirable. The magnetic flux blocking member in this embodiment is a piece of copper plate. The contour of the magnetic flux blocking member 16 in terms of its cross-section, is arcuate, and is roughly coaxial with the roller 1. It faces toward the coil 6, with the presence of the wall of the roller 1 between the magnetic flux blocking member 16 and the coil 6. It faces toward the coil 6 in such a manner that it faces roughly the entirety of the roller 1 in terms of the lengthwise direction of the roller 1 (roughly the entirety of heat generation range of roller 1). If the distance between the magnetic flux blocking member 16 and the peripheral surface of the roller 1 is greater than a certain value, the magnetic flux blocking member 16 is ineffective as a magnetic flux blocker.

On the other hand, if the distance is smaller than a certain value, it is possible that the magnetic flux blocking member 16 will come into contact with the peripheral surface of the roller 1. Therefore, it is necessary that the distance between the magnetic flux blocking member 16 and roller 1 is set to an optimal value determined in consideration of the above-described matter. As for the thickness of the magnetic flux blocking member 16 in terms of the diameter direction of roller 1, if it is less than a certain value, it is possible that the heat distribution of the roller 1 is affected by the heat that the magnetic flux blocking member 16 itself generates because of its own electrical resistance. On the other hand, if it is more than a certain value, it is possible that the magnetic flux blocking member 16 is large enough in thermal capacity to undesirably increase the wait-time. Thus, the thickness for the magnetic flux blocking member 16 has to be set to an optimal value determined in consideration of the above-described matter, and also, according to the specification of the image heating apparatus by which the magnetic flux blocking member 16 is employed.

In this embodiment, the recording sheet P is conveyed through the apparatus F in such a manner that the widthwise center line of the recording sheet P remains aligned with the center of the recording sheet passage of the apparatus F. Designated by a reference character S is the referential line (theoretical center line). That is, the recording sheet P is conveyed through the apparatus F in such a manner that its widthwise center line remains aligned with the center of the lengthwise direction of the roller 1 (center of heat generation range of roller 1), regardless of the size of the recording sheet P. In the case of the image forming apparatus in this embodiment, the size of the widest sheet of a recording medium (which may be referred to as large recording sheet P), in terms of the lengthwise direction of the roller 1, which is conveyable through the image forming apparatus equals to the dimension (297 mm) of the short edges of a sheet of size A3, for example, and the narrowest sheet of recording medium (which hereafter may be referred to as small sheet) equals the dimension (148 mm) of the short edges of a sheet of size A5, for example. Reference characters P1 stands for the width of the foot print of the large sheet, and P2 stands for the width of the foot print of the small sheet. In terms of the lengthwise direction of the roller 1, the position of the thermistor 11 coincides with the center of the roller 1, that is, roughly the center of the path P2 of a small sheet. That is, the thermistor 11 is positioned so that it will be within the recording-sheet path regardless of the recording-sheet dimension in terms of the rotational-axis direction O1-O1 of the roller 1.

As the main power switch (unshown) of the image forming apparatus is turned on, the control circuit 100 starts up the image forming apparatus, and also, starts the apparatus F in the startup mode (mode in which roller 1 is increased in temperature until its temperature reaches preset image heating level Tf). Further, it starts rotating the roller 1 by starting up the roller driving power source M1. Thus, the roller 2 begins to be rotated by the rotation of the roller 1. Further, the control circuit 100 begins causing the high frequency electric current to flow through the coil 6 by starting up the inverter 101, whereby alternating high frequency magnetic flux is generated in the adjacencies of the coil 6. Thus, heat is generated in the metallic core 1*a* of the roller 1 by electromagnetic induction, thereby causing the roller 1 to increase in temperature to the preset image heating level Tf (fixation level), which in this embodiment is 190° C. The preset image heating level Tf is lower than the preset Curie temperature, as described above. The temperature of the roller 1 is detected by the thermistor 11, and the information of the detected temperature level is inputted into the control circuit 100. As soon as the temperature of the roller 1 reaches 190° C., the control circuit 100 puts the image forming apparatus on standby (places apparatus in standby mode). While the image forming apparatus is in the standby mode, the control circuit 100 controls the amount of high frequency current flowing from the inverter 101 to the coil 6 so that the temperature of the roller 1 is kept at 190° C. across the entire range of the roller 1, which corresponds to the path P1 of large sheet. Then, as an image formation start signal is inputted into the control circuit 100 while the image forming apparatus is in the standby mode, the control circuit 100 starts an image forming operation, during which time the recording sheet P on which an unfixed toner image t is present is conveyed through the nip N while remaining pinched by the two rollers 1 and 2. Thus, the toner image t on the recording sheet P is thermally fixed to the surface of the recording sheet P by the heat from the roller 1, the temperature of which is being maintained at the preset image heating level Tf, and the pressure of the nip N. During the image heating process (image fixing process), the control circuit 100 controls the amount of high frequency current flowing from the inverter 101 to the coil 6, so that the information inputted into the control circuit 100 by the thermistor 11 regarding the temperature level detected by the thermistor 11 roughly matches the information regarding the preset image heating level Tf (190° C.). More concretely, during the image heating process, the roller 1 is controlled in temperature in such a manner that the amount of electric power supplied from the invertor 101 to the coil 6 is varied in response to the amount of difference between the temperature level detected by the thermistor 11 and the preset image heating level Tf, so that the temperature of the roller 1 is maintained at the preset image heating level Tf (190° C.). That is, the control circuit 100 controls the power supply from the invertor 101 to the coil 6 in such a manner that the temperature of the roller 1 is maintained at the preset image heating level Tf at least across the range which corresponds to the recording-sheet path, in response to the output of the thermistor 11. More specifically, if the temperature level (information regarding roller temperature) detected by the thermistor 11 and inputted into the control circuit 100 by the thermistor 11 is a preset anomaly detection level, which is higher than the preset image heating level Tf, the control circuit 100 stops supplying the coil 6 with the electric current from the invertor 101. Then, it stops driving the apparatus F and the on-going image forming operation of the image forming apparatus, and displays an error message on the monitor (unshown) to prompt a user to take necessary actions. The abovementioned anomaly detection temperature level in this embodiment is the same as the maximum temperature level Tm (230° C.) for the apparatus F.

Figure 4A:
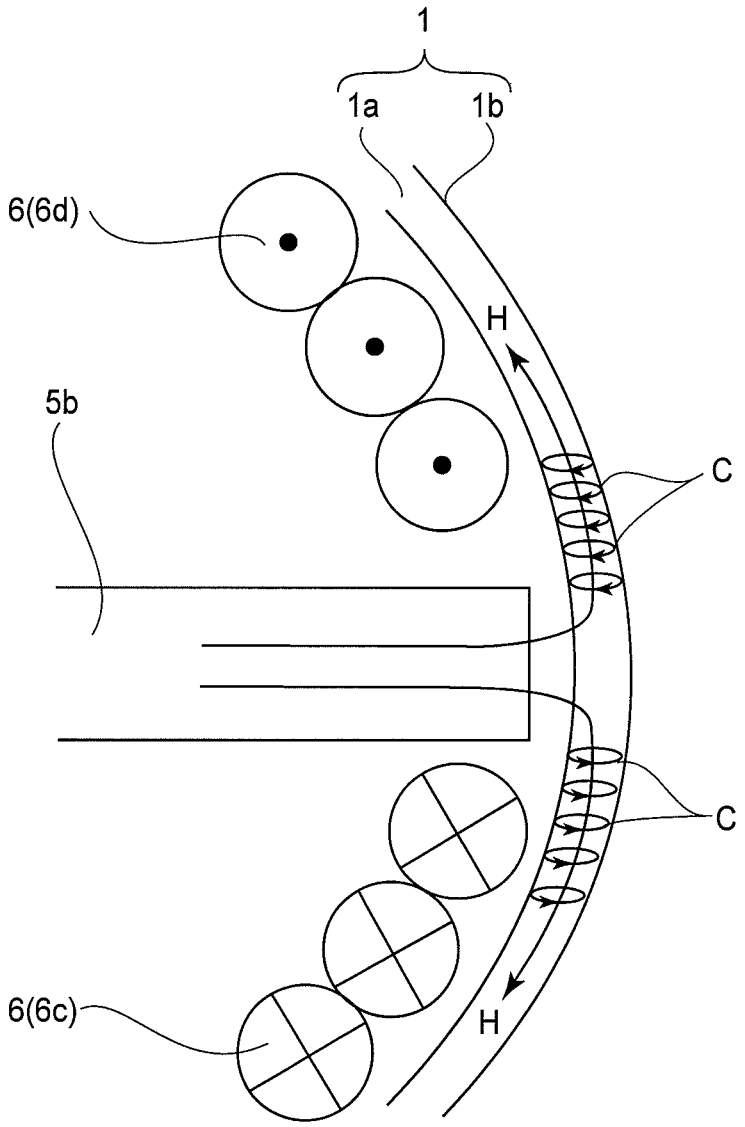
FIG. 4A is a schematic drawing for describing the principle based on which heat is generated in the heat roller.

Next, referring to FIG. 4A, the principle based on which heat is generated in the metallic core 1*a* of the roller 1, that is, the principle of heat generation by electromagnetic induction, will be described. To the coil 6, alternating electric current is supplied from the invertor 101. Thus, the formation and extinction of a magnetic flux designated by an arrow mark H occurs in the adjacencies of the coil 6. This magnetic flux H is guided by the magnetism passage formed by the core 5 (combination of portions 5*a* and 5*b*) and metallic core 1*a*. In response to the changes in the magnetic flux formed by the coil 6, eddy current occurs in the roller 1 in the direction to generate such a magnetic flux that counters the change of the magnetic flux generated by the coil 6, in the metallic core 1*a*. This eddy current is indicated by an arrow mark C. The eddy current C concentrates to the portion of the surface layer of the metallic core 1*a*, which faces the coil 6 (skin effect), generating thereby heat of an amount which is proportional to the amount of the surface resistance Rs (Ω) of the metallic core 1*a*. The skin depth δ (*m*) and skin resistance Rs (Ω) are obtainable by Equations 1 and 2 given below. Further, the amount of electric power W which is generated in the metallic core 1*a* is obtainable by Equation 3, which shows the amount If (A) of the eddy current induced in the metallic core 1*a*.

$$\delta = \sqrt{\frac{\rho}{\pi\mu f}} \tag{1}$$

$$Rs = \frac{\rho}{\delta} = \sqrt{\pi\mu\rho f} \tag{2}$$

$$W \propto Rs \int |If|^2 ds \tag{3}$$

As will be evident from the equations given above, what is necessary to increase the amount of heat generated in the metallic core 1*a* is to increase the amount If of the eddy current, or to increase the metallic core 1*a* in skin resistance Rs. What is necessary to increase the amount of the eddy current If is to strengthen the magnetic flux generated by the coil 6, or to increase the magnetic flux in the amount of change. That is, what is necessary is to increase the number of times the coil wires are wound in the coil 6, or to use a substance which is higher in magnetic permeability and lower in residual magnetic flux density as the maternal for the magnetic core 5. Further, the amount of the eddy current If induced in the metallic core 1*a* can be increased by reducing the gap α between the core 5 and metallic core 1*a*, since the reduction in the gap α results in an increase in the amount of the magnetic flux guided into the metallic core 1*a*. On the other hand, what is necessary to increase the metallic core 1*a* in the skin resistance Rs is to increase in frequence f the alternating current to be supplied to the coil 6 to reduce the magnetic core 1*a* in skin depth, and to select a substance which is high in magnetic permeability p and high in specific resistivity as the material for the metallic core 1*a*.

Figure 4B:
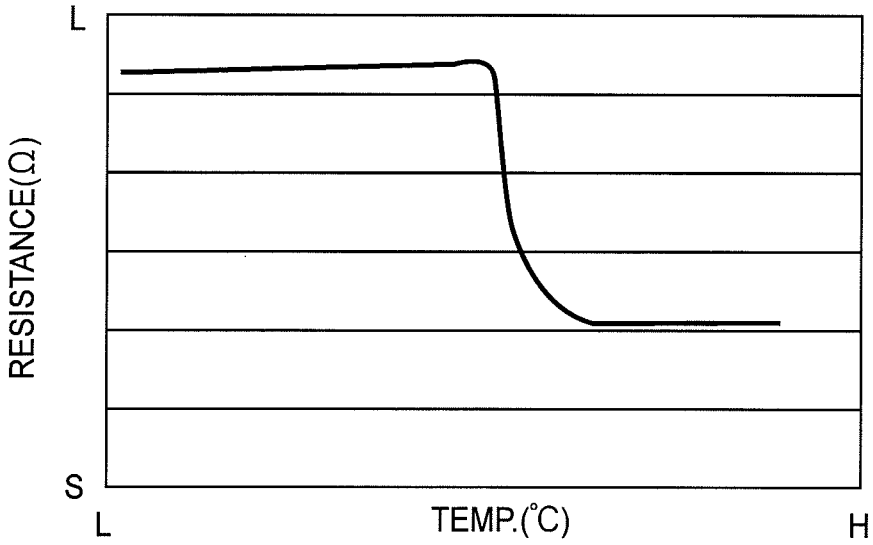
FIG. 4B is a graph which shows the dependency of the electrical resistance of the heat roller upon the temperature of the heat roller.
Figure 4C:
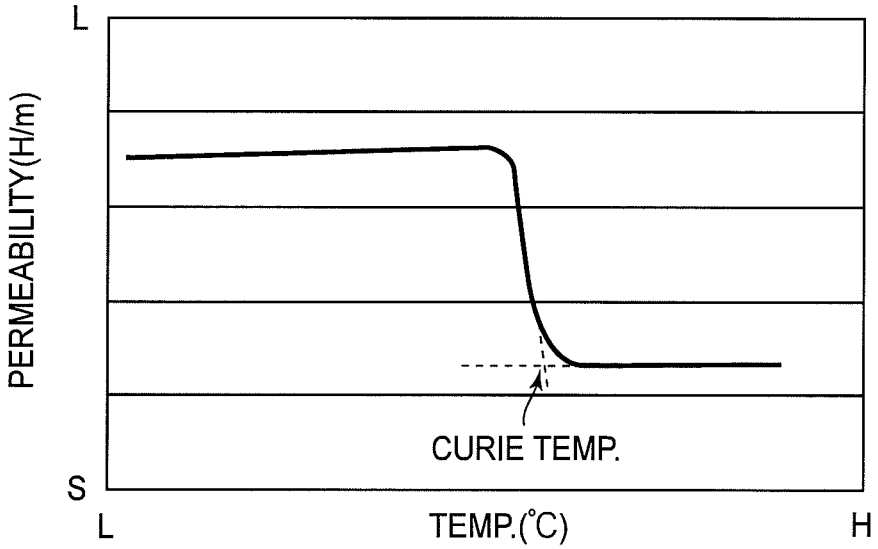
FIG. 4C is a graph which shows the dependency of the magnetic permeability of the heat roller upon the temperature of the heat roller.

Next, the Curie temperature is described. Generally, as a highly magnetic member is heated close to its Curie temperature, which is specific to the member, the spontaneous magnetization of the member decreases, thereby decreasing its magnetic permeability p. Therefore, if the temperature of the metallic core 1*a*, which is the electrically conductive portion of the roller 1, exceeds its Curie temperature, it reduces its skin resistance Rs. Consequently, the amount W of heat generated therein decreases. Also generally, if the electric current supplied to the coil 5 is not changed in frequency, the amount W is determined by the permeability p and resistivity p, as is evident from Equation 2. Generally, the resistivity gradually increases in proportion to the increase in temperature. The amount of electrical resistance Rs (skin resistance) of the heat roller is equivalent to the apparent resistance of the roller 1 as seen from the coil 6 side when electric current is flowing in the coil 6 while the magnetic flux generating means 3 is in its proper position in the roller 1. The amount of this apparent resistance of the metallic core 1*a* and the dependency of the apparent resistance upon temperature of the metallic core 1 are measured with the use of the following method. The equipment used for the measurement is an LCR meter (product of Agilent Technologies Co., Ltd; Model Number HP 4194A). The amount of electrical resistance of the heat roller was measured while applying an alternating current which is 20 kHz in frequency. The roller 1, the coil 6, and the core 5 were in their proper positions in the image heating apparatus. The amount of the electrical resistance of the roller 1 was measured while varying the roller 1 in temperature. Then, the obtained amounts of the electrical resistance of the roller 1 were plotted in the form of a graph, in FIG. 4B, the vertical axis of which stands for the electrical resistance of the roller 1, and the horizontal axis of which stands for the temperature of the roller 1, finding thereby the dependency of the amount of electrical resistance of the roller 1 upon the temperature of the roller 1, as indicated by the line in FIG. 4B. The roller 1 was changed in temperature while keeping the image heating apparatus in a thermostatic chamber and keeping stable the positional relationship between the roller 1 and magnetic flux generating means. The temperature of the roller 1 was measured using the above-described method after the roller temperature became the same as the temperature in the thermostatic chamber. The relationship between the measured electrical resistance of the roller and the temperature of the roller is as indicated by a curved line in FIG. 4B, indicating the dependency of the amount of electrical resistance of the roller upon the roller temperature. As for the permeability, it was measured with the use of a B-H analyzer (product of Iwatsu Test Instrument Co., Ltd; Model SY-8232). The magnetic permeability of a test piece was measured with the primary and secondary coils of the analyzer wound around the piece, while alternating electric current flowed, which was 20 kHz in frequency. The shape of the test piece does not matter as long as the coils can be wound around the piece (ratio between two temperature levels which are different in magnetic permeability of metallic core hardly changes). After the coils were wound around the test piece, the combination was placed in a thermostatic chamber and was left therein until the chamber became stable in temperature. Then, the test piece was measured in permeability. Then, the obtained values of the permeability of the test piece were plotted in a graph, in FIG. 4C, the vertical axis of which stands for the magnetic permeability of the test piece, and the horizontal axis of which stands for the temperature, finding out the dependency of the amount of the magnetic permeability of the test piece upon the temperature of the test piece. That is, the dependency of the permeability of the test piece upon the temperature of the test piece can be proven by measuring the amount of the magnetic permeability of the test piece while changing the thermostatic chamber in temperature. As the thermostatic chamber was increased in temperature, the test piece significantly reduced to a certain level in magnetic permeability at a certain temperature level, and then, it remained virtually the same in the amount of magnetic permeability even through the thermostatic chamber was increased in temperature. The Curie temperature is the temperature level beyond which the test piece did not change in permeability. As the results of the measurement of the amount of the magnetic permeability of the test piece were plotted in a graph, in FIG. 4C, the vertical axis of which stands for the magnetic permeability of the test piece, and the horizontal axis of which stands for the temperature of the test piece, the dependency of the magnetic permeability of the test piece upon the temperature of the test piece became as indicated by a curved line in FIG. 4C. More concretely, the Curie temperature of the test piece is the temperature of the test piece, which corresponds to the intersection of the downward extension of the straight portion of the line, in FIG. 4C, which indicates the sudden drop in the magnetic permeability of the test piece, and the extension, in the low temperature direction, of another straight portion of the line, which indicates the consistency of the magnetic permeability of the test piece when the temperature of the test piece was higher than the certain level.

Figure 5:
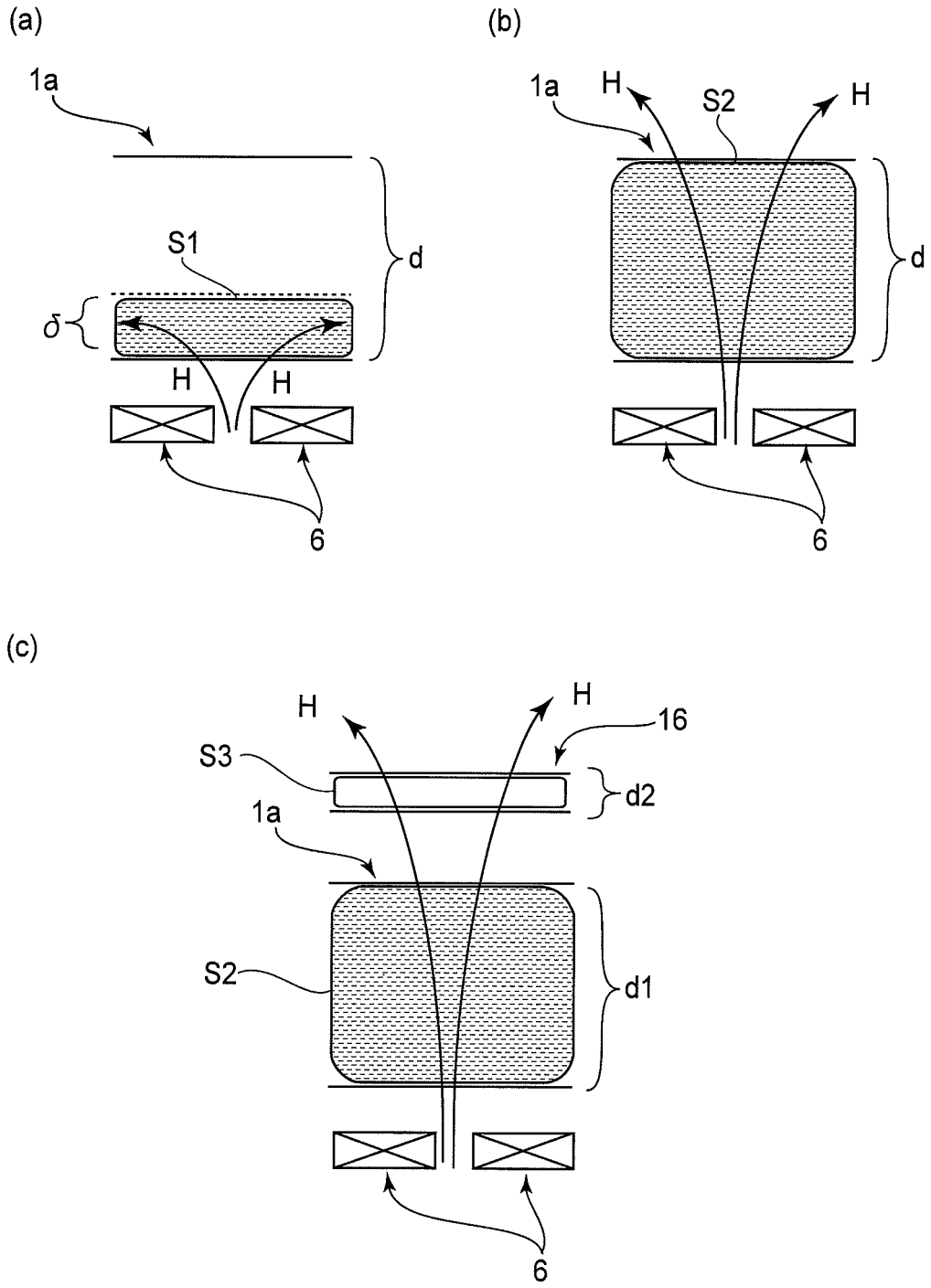
FIG. 5 is a combination of drawings, FIG. 5(*a*), FIG. 5(*b*), and FIG. 5(*c*), which shows the heat generation areas of the image heating member made of a magnetism-adjusted alloy, and the heat generation area of the magnetic flux blocking member.

Next, referring to FIGS. 5(*a*), 5(*b*), and 5(*c*), the heat generating range of the roller 1 in this embodiment, in terms of the thickness direction of the roller 1 will be described. Designated by a reference character d is a thickness of the metallic core 1*a*. When the temperature of the metallic core 1*a* is no more than the Curie temperature, the magnetic flux H passes the portion S1 of the metallic core 1*a*, the thickness of which corresponds to the skin depth 6 (when metallic core temperature is no more than Curie temperature) of the metallic core 1*a*, as shown in FIG. 5(*a*), and therefore, the portion S1 generates heat. On the other hand, when the temperature of the metallic core 1*a* becomes no less than the Curie temperature, the metallic core 1*a* decreases in magnetic permeability, and the magnetic flux generated by the coil 6 penetrates past the metallic core 1*a*, as shown in FIG. 5(*b*), provided that the skin depth 6*c* at this temperature of the metallic core 1*a* is greater in value than the thickness d of the metallic core 1*a*. In this case, the portion S2 of the metallic core 1*a*, which is equivalent to the thickness of the wall of the metallic core 1*a*, generates heat. The amount by which eddy current in induced in the metallic core 1*a* is not affected by the Curie temperature. Thus, based on Equations 2 and 3, there is the following relationship between the amount W1 of heat generated in the metallic core 1*a* when the temperature of the metallic core 1 is no more than the Curie temperature, and the amount W2 of heat generated in the metallic core 1*a* when the temperature of the metallic core 1*a* is no less than the Curie temperature: $W2=\delta W1/d$. FIG. 5(*c*) shows the case in which the magnetic flux blocking member 16 (which in this embodiment is made of piece of copper plate) is in the adjacencies of the metallic core 1*a*. In this case, if the temperature of the metallic core 1*a* is no more than the Curie temperature, the magnetic flux H flows within the metallic core 1*a*, and therefore, the portion S1 of the surface portion of the metallic core 1*a* generates heat. On the other hand, if the temperature of the metallic core 1*a* is no less than the Curie temperature, the magnetic flux H penetrates through the metallic core 1*a*, and then, through the magnetic flux blocking member 16. In this case, the portion S2, which corresponds in thickness to the thickness of the wall of the metallic core 1*a*, and the portion S3, which corresponds in thickness to the thickness of the magnetic flux blocking member 16, generate heat. The magnetic flux blocking member 16 is an electrically conductive member, and is smaller in resistivity than the magnetism-adjusted-alloy of which the metallic core 1*a* is formed. Thus, eddy current is induced more in the magnetic flux blocking member 16 than in the metallic core 1*a*. In other words, when there is no magnetic flux blocking member 16 in the adjacencies of the metallic core 1*a*, the amount of the eddy current induced in the metallic core 1*a* is smaller, and therefore, the amount of heat generated in the magnetic core 1*a* is smaller, than when there is the magnetic flux blocking member 16 in the adjacencies of the metallic core 1*a*. Further, because the magnetic flux blocking member 16 is smaller in resistivity than the metallic core 1*a*, even if a greater amount of an eddy current is induced in the magnetic flux blocking member 16 than in the metallic core 1*a*, the amount of heat generated in the magnetic flux blocking member 16 itself is not significantly large. That is, as the temperature of the metallic core 1*a* increases beyond the Curie temperature, the magnetic flux H penetrates through the metallic core 1*a* and induces eddy current in the magnetic flux blocking member 16. Thus, when the temperature of the metallic core 1*a* is no less than the Curie temperature, the amount of heat generated in the metallic core 1*a* decreases, converging to the amount of heat generated in the metallic core 1*a* when the temperature of the magnetic core 1*a* is in the adjacencies of the Curie temperature Tc of the magnetism-adjusted-alloy of which the metallic core 1*a* is made. Thus, as a substantial number of small recording sheets are continuously conveyed through the apparatus F, the temperature of the out-of-sheet-path-portions of the roller 1 converges to the level at which the temperature of the metallic roller 1*a* is in the adjacencies of the Curie temperature of the material of which the metallic core 1*a* is made. In other words, it is possible to reduce the amount by which the out-of-sheet-path-portions of the roller 1 unnecessarily increase in temperature when a substantial number of recording sheets P are continuously conveyed through the apparatus F.

(3) Positioning and Size of Magnetic Flux Blocking Member 16

Next, the positioning and size of the magnetic flux blocking member 16 in this embodiment is described. Referring to FIG. 3C, a reference character E stands for the ranges, in terms of the circumferential direction of the roller 1, across which the core 5 (combination of portions 5*a* and 5*b*) squarely opposes the roller 1, and which may be referred to as the first opposing range hereafter. A reference character G stands for the ranges, in terms of the circumferential direction of the roller 1, across which the first and second portions 6*c* and 6*d*, respectively, of the coil 6 squarely oppose the roller 1, and which may be referred to as the second opposing portions hereafter. The magnetic flux blocking member 16 opposes the roller 1 in the second opposing ranges G. In this embodiment, in terms of the circumferential direction of the roller 1*a*, the portion of the peripheral surface of the roller 1, which the first portion 6*c* of the coil 6 opposes, will be referred to as the first opposing surface portion. The size (length) of the first opposing surface portion of the roller 1 is equivalent to roughly 60° in terms of the rotational angle of the roller 1*a*. This angle is the angle between the line which connects one end of the first portion 6*c* of the coil 6, in terms of the rotational direction of the roller 1, to the rotational axis of the roller 1, and the line which connects the other end of the first portion 6*c* of the coil 6, to the rotational axis of the roller 1. Further, the portion of the peripheral surface of the roller 1, which the first portion 6*d* of the coil 6 opposes, will be referred to as the first opposing surface portion. The size (length) of the first opposing surface portion of the roller 1 is also equivalent to roughly 60° in terms of the rotational angle of the roller 1*a*. This angle is the angle between the line which connects one end of the first portion 6*d* of the coil 6, in terms of the rotational direction of the roller 1 to the rotational axis of the roller 1, and the line which connects the other end of the first portion 6*c* of the coil 6 to the rotational axis of the roller 1. In this embodiment, in terms of the rotational direction of the roller 1, the magnetic flux blocking member 16 opposes the roller 1 in the second opposing range G (which is different from first opposing range E), in which the second portion 6*d* of the coil 6 opposes the roller 1. Also in terms of the rotational direction of the roller 1, designated by a reference character J is the range, across which the magnetic flux blocking member 16 opposes the roller 1, and which will be referred to as the third opposing range. The theoretical plane (first plane) in which the portion 6*d* of the coil 6 opposes roller 1 across the second opposing range G, and the theoretical plane in which the magnetic flux blocking member 16 opposes the roller 1 across the third opposing range J are roughly parallel. Further, assuming that the dimension of the second opposing range G in the rotational direction of the roller 1 (image heating member) is L2, and the dimension of the third opposing range J in the rotational direction of the roller 1 (image heating member) is L3, there is the following relationship between L2 and L3: L2/2

L3, which characterizes this embodiment. Hereafter, this characteristic is concretely described.

Figure 6:
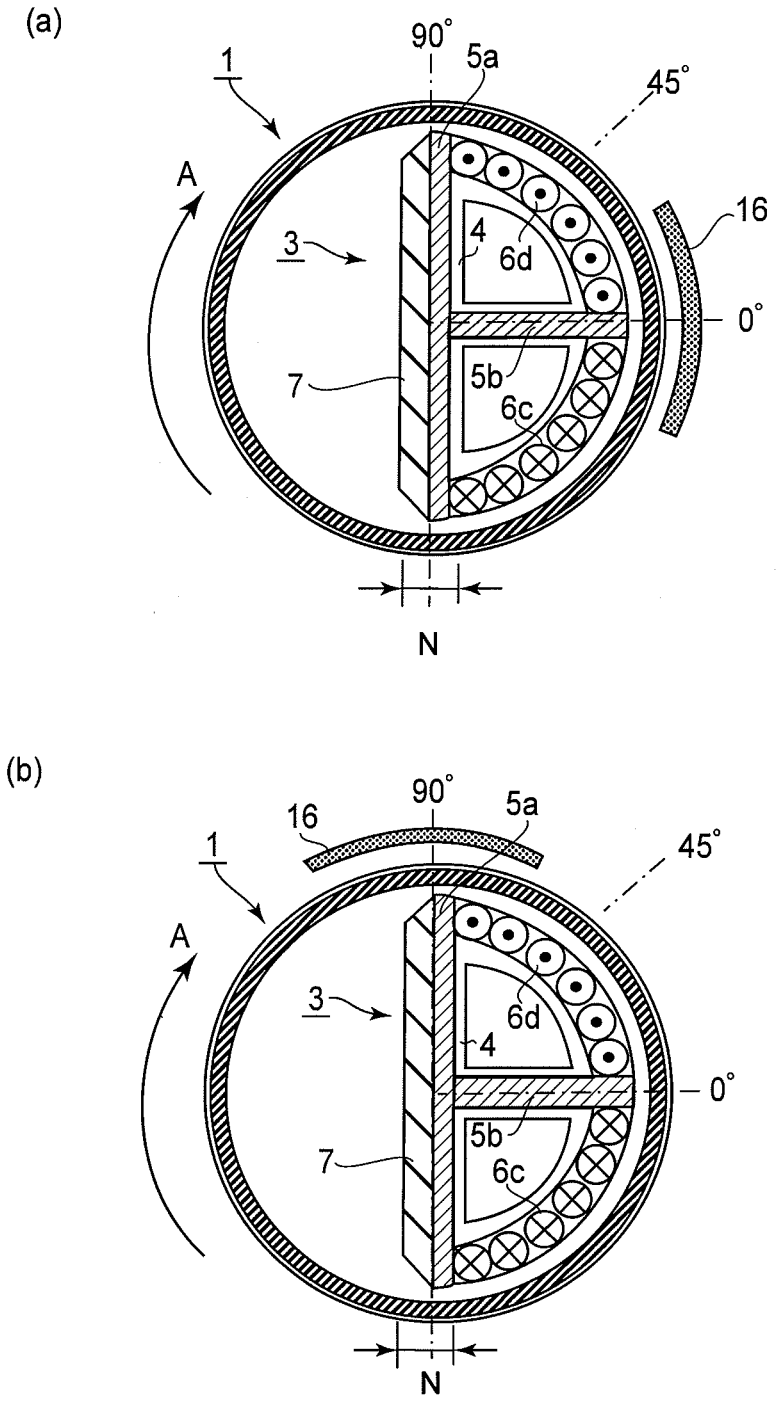
FIG. 6 is a combination of two schematic cross-sectional views of the heat roller and magnetic flux blocking member in the first embodiment, FIG. 6(*a*) and FIG. 6(*b*), and shows the positioning of the magnetic flux blocking member relative to the heat roller.
Figure 7:
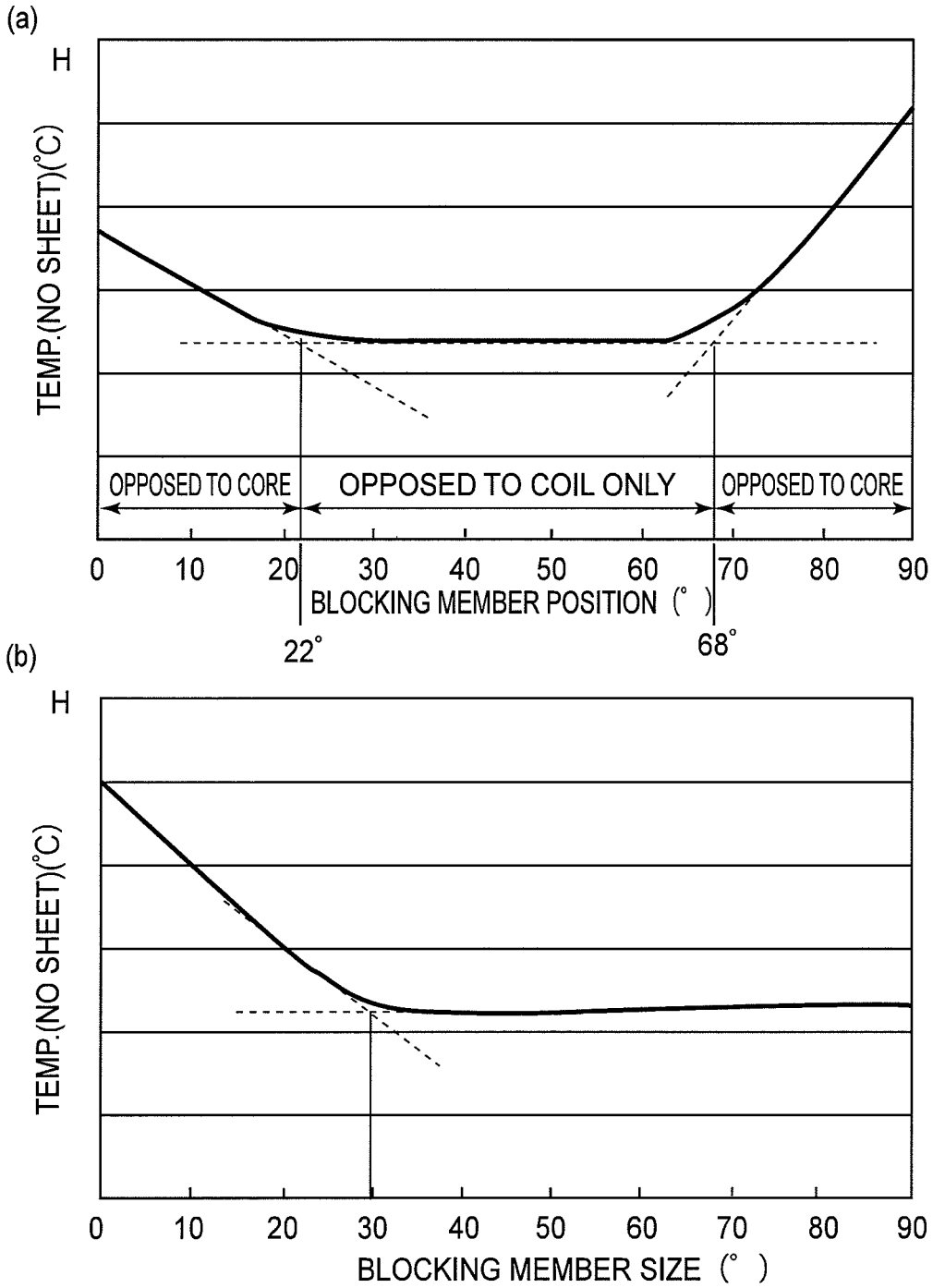
FIG. 7(*a*) is a graph which shows the relationship between the position of the magnetic flux blocking member and the temperature of the out-of-sheet-path-portions of the heat roller.

The magnetic flux blocking member 16, or the magnetic flux blocking member in this embodiment, is made of a piece of copper plate. It is arcuate in cross-section, and is roughly coaxial with the roller 1. Its length is roughly the same as that of the roller 1, and extends roughly from one end of the roller 1 to the other (one end of actual heat generation range of roller 1). The dimension (length) of the magnetic flux blocking member 16 in terms of the circumferential direction of the roller 1 is equivalent to 45°, and the thickness of the magnetic flux blocking member 16 is 0.8 mm. The distance (gap) of the magnetic flux blocking member 16 from the roller 1 is 2.0 mm. The abovementioned angle is equal to the angle between the straight line which connects one end of the magnetic flux blocking member 16 in terms of the rotational direction of the roller 1 and the rotational axis of the roller 1, and the straight line which connects the other end of the magnetic flux blocking member 16 and the rotational axis of the roller 1. Next, referring to FIGS. 6(*a*) and 6(*b*), the referential point (0°) for the position of the magnetic flux blocking member 16 in terms of the circumferential direction of the roller 1 is where the theoretical extension of the center portion 5*b* of the core 5 in terms of the radial direction of the roller 1 intersects with the roller 1. The apparatus F is structured so that, the magnetic flux blocking member 16 can be moved 90° upstream in terms of the rotational direction of the roller 1 from its referential position while maintaining the aforementioned 2.0 mm of distance from the roller 1. With the apparatus F structured as described above, the changes which occurred to the temperature of the out-of-sheet-path-portion of the roller 1 when a substantial number of recording sheets of B4 size (vertical conveyance) were continuously conveyed through the apparatus F were detected. More specifically, the magnetic flux blocking member 16 was placed in various positions within the aforementioned range (0°-90°), and the temperature of the out-of-sheet-path-portion of the roller 1 was measured while the substantial number of recording sheets were continuously conveyed through the apparatus F with the magnetic flux blocking member 16 placed in each of the specific positions in the abovementioned range. The results of the measurement are given in FIG. 7(*a*). It is evident from FIG. 7(*a*) that when the position of the magnetic flux blocking member 16 was no more than 22° and no less than 68° C., the out-of-sheet-path-portions of the roller 1 increased in temperature. In other words, that the position of the magnetic flux blocking member 16 is no more than 22° or no less than 68° means that the magnetic flux blocking member 16 was within the first opposing range E, that is, the range across which the core 5 (combination of portions 5*a* and 5*b*) opposes the roller 1. That is, as long as the magnetic flux blocking member 16 is positioned so that it is outside the first opposing range E, that is, the range across which the core 5 opposes the roller 1, the magnetic flux blocking member 16 does not need to be as large as it has been conventionally, making it possible to reduce the apparatus F in thermal capacity and cost.

An experiment was carried out, in which multiple magnetic flux blocking members (16), which are the same (0.8 mm) in thickness, but are different in their size in terms of the circumferential direction of the roller 1, were tested. The distance between the magnetic flux blocking members and roller 1 was kept the same (2.0 mm). As in the above-described experiment, the changes in the temperature of the out-of-sheet-path-portions of the roller 1, which occurred when the substantial number of recording sheets were continuously conveyed through the apparatus F, were detected. The results of the detection are given in FIG. 7(*b*). It is evident from FIG. 7 (*b*) that the image heating apparatuses which were greater than 30° in the size of their magnetic flux blocking member (16) were roughly the same in the temperature of the out-of-sheet-path-portions of their roller (1). In other words, all magnetic flux blocking members (16) which are no less than ½ the angle (60°) of the range across which the coil 6 opposes the roller 1 in terms of the circumferential direction of the roller 1 are the same in effectiveness.

Thus, the magnetic flux blocking member 16 in this embodiment was positioned in the second opposing range G (which is different from first opposing range E). The relationship between its size L2, which is the dimension of magnetic flux blocking member 16 in terms of the rotational direction of the roller 1 (rotational direction of image heating member), in the second opposing range G, and its size L3, which is the dimension of the magnetic flux blocking member 16 in terms of the rotational direction of the roller, in the third opposing range J, was made to be as follows: $L2/2 \leq L3$. Thus, the magnetic flux blocking member 16 had a maximum effectiveness. That is, the present invention can optimally position the magnetic flux blocking member 16, and also, determines the optimum size for the magnetic flux blocking member 16. Thus, it can improve an image heating apparatus in terms of the unnecessary temperature increase in the out-of-path-portions of its image heating member (roller), without increasing the apparatus in the length of the warm-up time. Further, the present invention can reduce the magnetic flux blocking member 16 in the amount by which its temperature is increased by the heat generated therein by the electric current induced therein.

Embodiment 2

Figure 8:
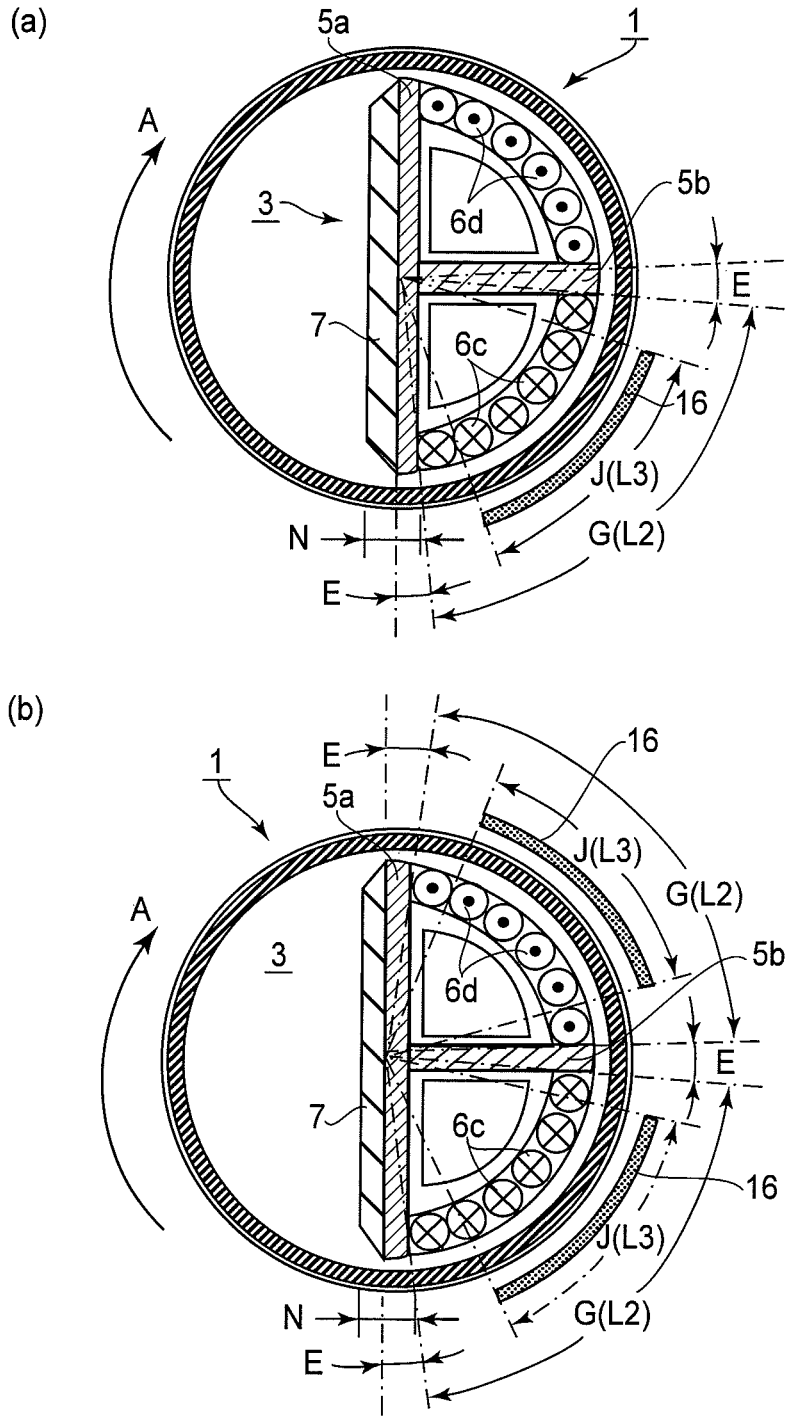
FIG. 8 is a combination of two schematic cross-sectional views of the image heating apparatus in the second preferred embodiments of the present invention, FIG. 8(*a*) and FIG. 8(*b*) and depicts the structure of the apparatus.

Referring to FIG. 8(*a*), in terms of fixing apparatus structure (image heating apparatus structure), this embodiment is similar to the first embodiment, except that the apparatus F in this embodiment was structured so that the magnetic flux blocking member 16 opposed the first portion 6*c* of the coil 6, with the presence of the wall of the roller 1 between itself and the first portion 6*c*. The apparatus F may be structured so that the magnetic flux blocking member 16 opposes both the first and second portions 6*c* and 6*d*, respectively, of the coil 6 as shown in FIG. 8(*b*).

Embodiment 3

Figure 9A:
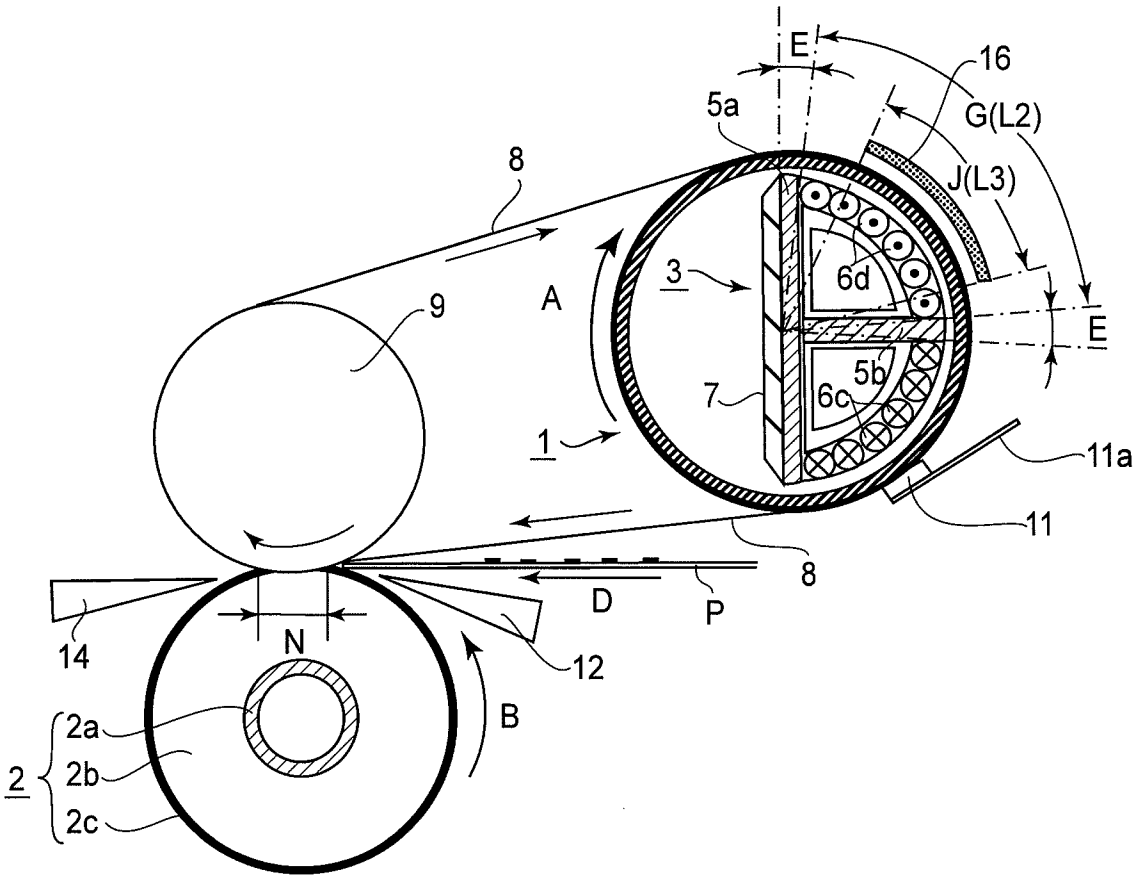
FIG. 9A is a schematic cross-sectional view of the image heating apparatus in the third preferred embodiment of the present invention, and depicts the structure of the apparatus.

Referring to FIG. 9A, the image heating apparatus in this embodiment employs a heating member which is in the form of an endless belt. More specifically, it has a heat roller 1, a belt backing roller 9, and an endless belt 8. The belt backing roller 9 is parallel to the roller 1, and supports and keeps stretched the endless belt 8. The endless belt 8 is supported and kept stretched by the rollers 1 and 9. The image heating apparatus has also a pressure applying elastic roller 2, which is kept pressed upon the roller 9, with the presence of the belt 8 between the rollers 9 and 2, forming thereby a nip N. The roller 1 in this embodiment is the same in structure as that in the first embodiment. That is, there is also a coil assembly 3 in the hollow of the roller 1, and the roller 1 is heated by the heat generated by the eddy current induced therein. Further, the image heating apparatus in this embodiment has the magnetic flux blocking member 16 and thermistor 11, which are in the same positions as those in which the counterparts in the first embodiment were. The roller 9 rotates in the same direction as the roller 1. The belt 8 is circularly moved by the rotation of the roller 1, and the roller 9 is rotated by the circular movement of the belt 8. The belt 8 is heated by the roller 1 so that its temperature is increased to, and remains at, a preset level (image heating level Tf). As the recording sheet P on which an unfixed toner image t is present is introduced into the nip N, the unfixed toner image t is fixed to the surface of the recording sheet P by the combination of the heat from the belt 8, and the nip pressure. Incidentally, the belt 8 may be formed of a metallic alloy which was adjusted in Curie temperature so that it would have a preset value in Curie temperature.

Embodiment 4

Figure 9B:
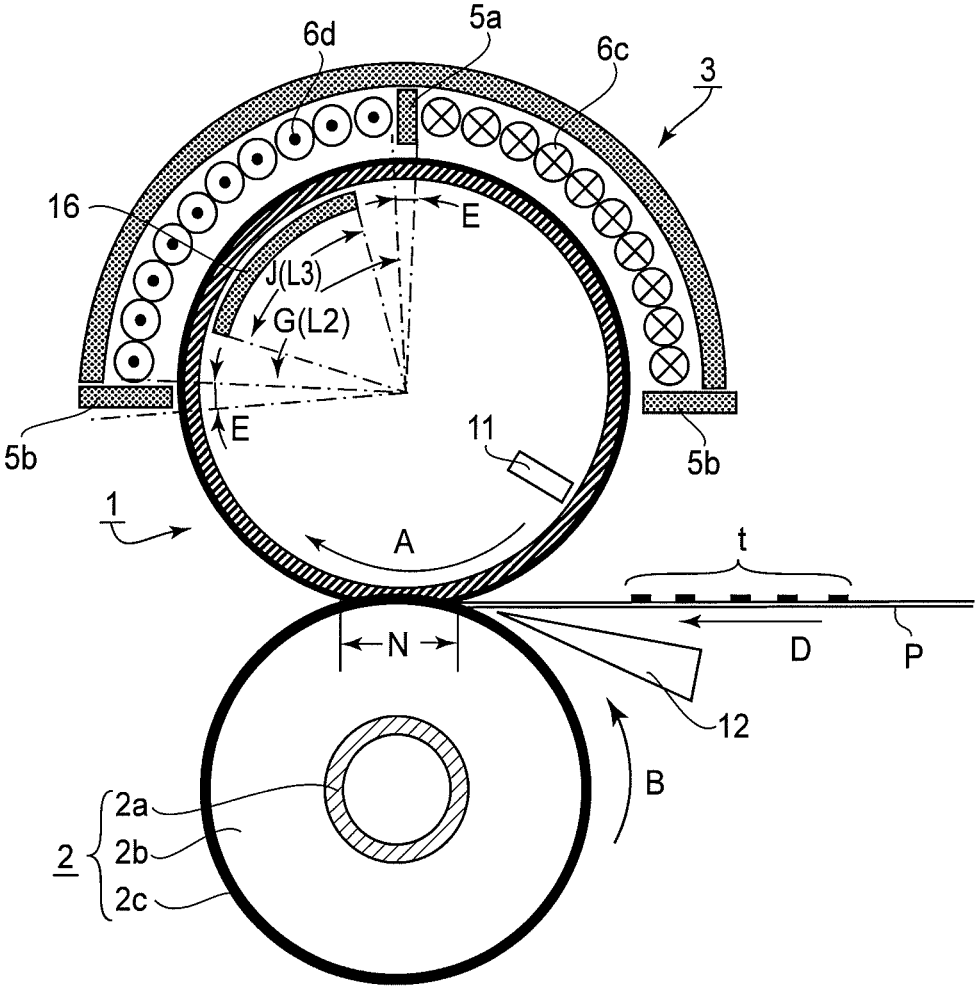
FIG. 9B is a schematic cross-sectional view of the image heating apparatus in the fourth preferred embodiment of the present invention, and depicts the structure of the apparatus.

In the first to third embodiments, the image heating apparatuses were structured so that the coil 6 was positioned in the hollow of the roller 1 to heat the roller 1 from within the roller 1. However, an image heating member may be structured as shown in FIG. 9B. That is, the coil 6 may be positioned in the outward adjacencies of the roller 1. In the case where the coil 6 is positioned out side the roller 1, the thermistor 11 is positioned so that it opposes the roller 1 from within the hollow of the roller 1. Otherwise, the image heating apparatus in this embodiment is the same in structure as those in the preceding embodiments.

Embodiment 5

Figure 10:
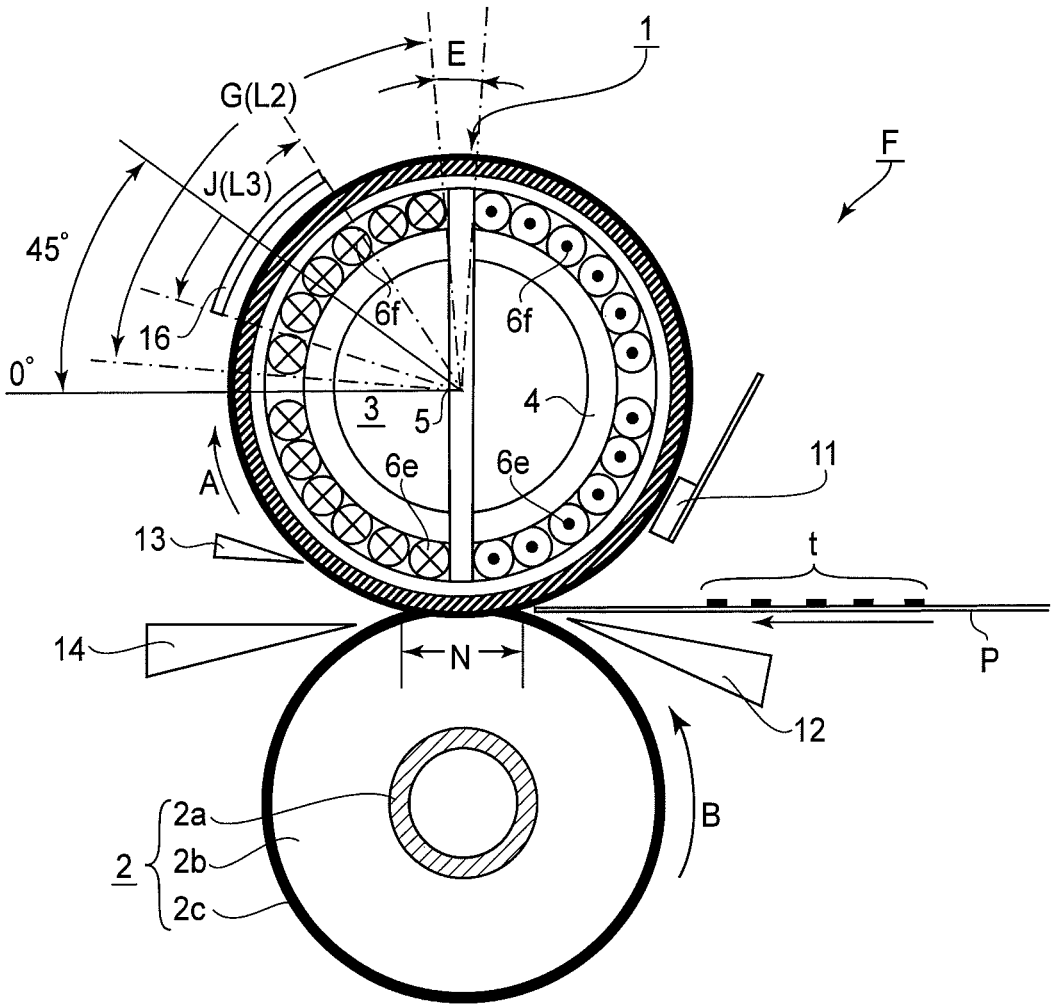
FIG. 10 is a schematic cross-sectional view of the image heating apparatus in the fifth preferred embodiment of the present invention, and depicts the structure of the apparatus.

Next, the image heating apparatus in the fifth embodiment of the present invention is described about its structure, referring to FIG. 10, which is a schematic cross-sectional view of the image heating apparatus, and in which the core 5 is designated by a reference character I. In the case of the image heating apparatus in this embodiment, the Curie temperature of its heat roller 1 is roughly 200° C. In terms of the circumferential direction of the roller 1, the coil 6, which is made up of portions 6*e* and 6*f*, opposes virtually the entirety of the heat roller 1. The magnetic core 5 for guiding the magnetic fluxes, which the portions 6*e* and 6*f* of the coil 6 generate, is rectangular, and is between the portions 6*e* and 6*f* of the coil 6. The magnetic flux blocking member 16 in this embodiment also is made up of a piece of copper plate. It is on the upstream side of the fixation nip N in terms of the rotational direction of the roller 1. It is 40° in size in terms of the angle in the circumferential direction, 0.8 mm in thickness, and 2.0 in the distance from the roller 1. It opposes the core 5 and the portions 6*e* and 6*f* of the coil 6, with the presence of the wall of the metallic core 1*a* between the core 5 and portions 6*e* and 6*f*. In terms of the circumferential direction of the roller 1, the ranges across which the portions 6*e* and 6*f* of the coil 6 oppose the roller 1 one for one are roughly 70°. Since the coil 6, which is a combination of the portions 6*e* and 6*f*, opposes virtually the entirety of the roller 1, it can heat virtually the entirety of the roller 1 in terms of the circumferential direction of the roller 1. Therefore, the roller 1 in this embodiment is less nonuniform in temperature in terms of its lengthwise direction compared to any of the rollers in the preceding embodiments. Thus, the image forming apparatus (image heating apparatus) does not need to be idled to be made its heat roller uniform in temperature in its lengthwise direction, being therefore smaller in the amount of electric power consumption.

Figure 11:
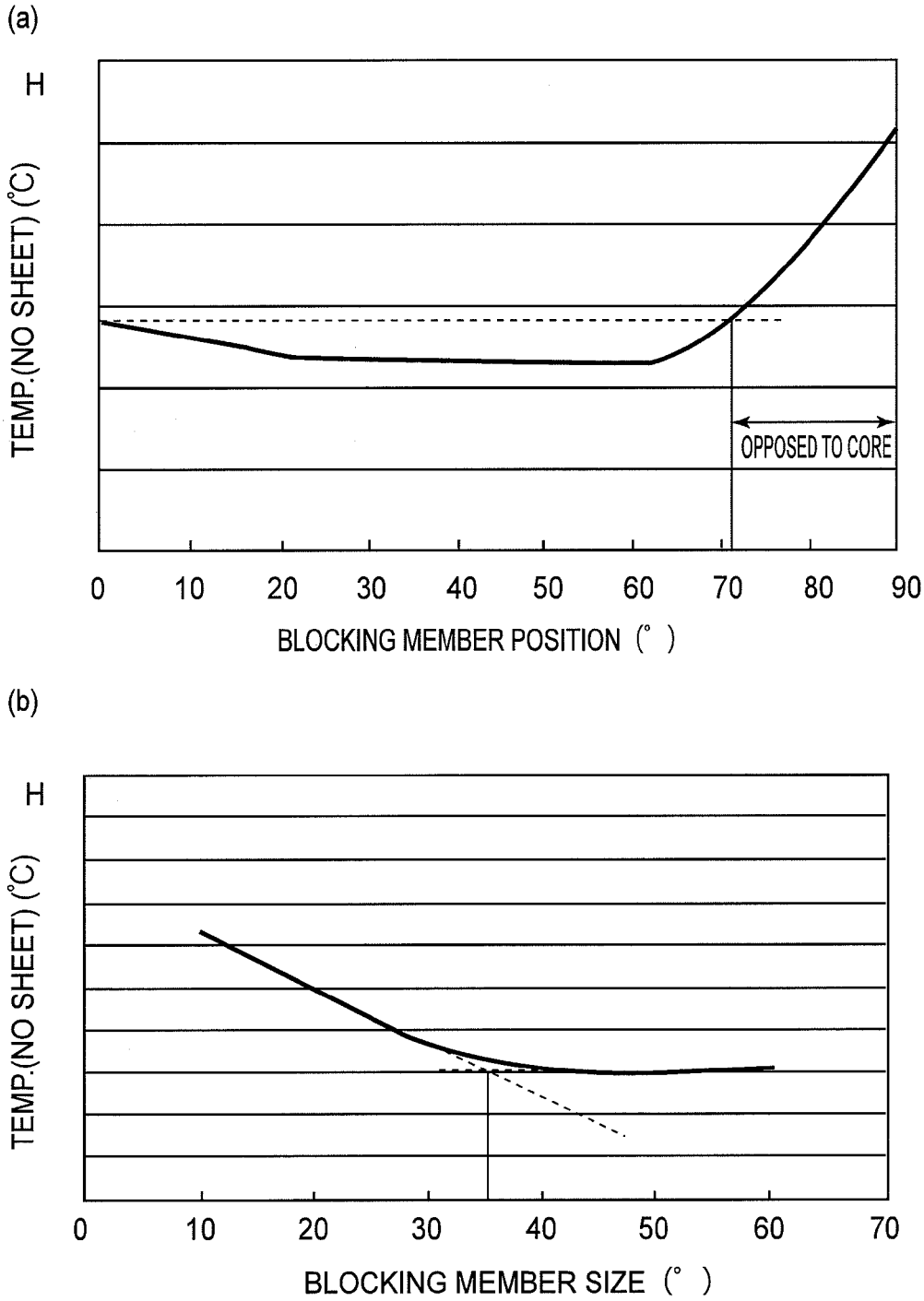
FIG. 11(*a*) is a graph which shows the relationship between the position of the magnetic flux blocking member of the image heating member, and the temperature of the out-of-sheet-path-portions of the heat roller, in the fifth embodiment.

The image heating apparatus in this embodiment, which is the same in structure as that in the second embodiment, except for the magnetic coil 6, was subjected to an experiment, in which the magnetic flux blocking member 16 was varied in the position relative to the magnetic coil 6, and the temperature of the out-of-sheet-path-portions of the roller 1 was measured while continuously conveying (vertical conveyance) a substantial number of recording sheets which were B5 in size. The results of the measurement are given in FIG. 11(*a*). It is evident from FIG. 11(*a*) that in the case where the position (angle) of the magnetic flux blocking member 16 from the referential point in the rotational direction of the roller 1 is no less than 72° C., the greater the angle, the higher the amount by which the out-of-sheet-path-portions of the roller 1 unnecessary increased in temperature. In other words, that the angle of the magnetic flux blocking member 16 is no less than 72° means that the magnetic flux blocking member 16 is squarely opposing the core 5. That is, according to the experiment carried out to test the structural arrangement for the image heating apparatus in this embodiment, the magnetic flux blocking member 16 to be employed by an image heating member structured so that the magnetic flux blocking member 16 does not oppose the core 5 does not need to be as large as a conventional one. In other words, structuring an image heating apparatus as the image heating apparatus in this embodiment is structured can reduce an image heating apparatus in thermal capacity and cost.

Next, another experiment to which the image heating apparatus in this embodiment was subjected is described. In this experiment, multiple magnetic flux blocking members 16, which were 0.8 mm in thickness, 2.0 mm in the distance from the roller 1, and different in size in terms of the circumferential direction of the roller 1, were positioned at 45° (in clockwise direction from referential position (0° in FIG. 10; magnetic flux blocking member 16 is horizontal), and the changes in the temperature of the out-of-sheet-path-portion of the roller 1 were detected for each magnetic flux blocking member 16 while conveying a substantial number of recording sheets, which were B5 in size. The results of the experiment are given in FIG. 11(*b*). It is evident from FIG. 11(*b*) that the magnetic flux blocking members that are no less than roughly 35° in size (angle in terms of the circumferential direction of the roller 1) are roughly the same in the temperature of the out-of-sheet-path portion of the roller 1. In other words, as long as the magnetic flux blocking member 16 is no less in size (angle) than ½ the angle (70°) by which the coil 6 opposes the roller 1, its effect remains the same regardless of size.

As described above, the magnetic flux blocking member 16 can be maximized in its effect by positioning it outside the range across which the magnetic core 5 opposes the roller 1, and making its size (angle in terms of circumferential direction of roller 1) no less than ½ the range (70°) across which the coil 6 opposes the roller 1.

Incidentally, the structure of the image heating apparatus in the second embodiment was not described to limit the present invention in scope. That is, the present invention is also applicable to many other image heating apparatuses which are different in structure from the image heating apparatuses in the first to fourth embodiment, with slight or no modifications.

According to the present invention, it is possible to provide an image heating apparatus, the magnetic flux blocking member of which is stationary, and yet, is substantially superior to any of the conventional image heating apparatuses, in terms of the prevention of the unnecessary increase in the temperature of the out-of-sheet-path-portion of its heating member.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 240323/2009 filed Oct. 19, 2009 which is hereby incorporated by reference.

What is claimed is:

1. An image heating apparatus's comprising:

a hollow heating roller, including an electroconductive layer of magnetism-adjusted alloy having a Curie temperature lower than a heat-resistant temperature of said apparatus, configured to heat an image on a sheet;

an excitation coil provided in said heating roller and configured to generate a magnetic flux for heating said heating roller, said excitation coil being wound about a winding center;

a first magnetic core provided in said heating roller and configured to direct the magnetic flux to said heating roller, said first magnetic core including a first end portion positioned in the winding center and adjacent to said heating roller;

a second magnetic core provided in said heating roller and configured to direct the magnetic flux to said heating roller, said second magnetic core including a second end portion adjacent to said heating roller not through said excitation coil;

a controller configured to control electric power supply to said excitation coil so that a temperature of said heating roller is maintained at a target temperature lower than the Curie temperature; and a magnetic flux shielding plate provided so as to oppose said excitation coil through said heating roller and configured to shield the magnetic flux when said heating roller is heated up to a temperature higher than the Curie temperature, said magnetic flux shielding plate being made of a non-magnetic metal having a resistivity smaller than that of said magnetism-adjusted alloy and being stationary relative to said heating roller, wherein said magnetic flux shielding plate is disposed within an angular range between a first angular position in which said first end portion is positioned and a second angular position in which said second end portion is positioned and excluding the first angular position and the second angular position, and wherein a length of said magnetic flux shielding plate is the same or larger than a half length of the angular range, in a rotational direction of said heating roller.

2. An apparatus according to claim 1, wherein said controller controls the electric power such that a skin depth said electroconductive layer when the temperature of said heating roller is lower than the Curie temperature is smaller than a thickness of said electroconductive layer, and the skin depth when the temperature of said heating roller is higher than the Curie temperature is larger than the thickness of said electroconductive layer.

3. An apparatus according to claim 1, wherein said magnetic flux shielding plate has an arcuate configuration substantially concentric with said heating roller.

4. An apparatus according to claim 1, wherein said first magnetic core and said second magnetic core are integral with each other to form a T-shape.

5. An apparatus according to claim 1, wherein said second magnetic core further includes a third end portion adjacent to said heating roller, not through said excitation coil.

6. An apparatus according to claim 1, further comprising a rotary member configured to form a nip portion in which the sheet is nipped and conveyed cooperatively with said heating roller.

7. An apparatus according to claim 1, wherein said magnetism-adjusted alloy is comprised of iron, nickel, chrome, and said magnetic flux shielding plate is made of copper.

8. An image heating apparatus comprising:

a hollow heating roller, including an electroconductive layer made of magnetism-adjusted alloy having a Curie temperature lower than a heat-resistant temperature of said apparatus, configured to heat a toner image on a sheet;

an excitation coil provided in said heating roller and configured to generate a magnetic flux for heating said heating roller, said excitation coil being wound about a winding center;

a substantially T-shaped magnetic core having a substantially T-shaped cross-section and provided in said heating roller and configured to direct the magnetic flux to said heating roller, said T-shaped magnetic core including a first end portion positioned in the winding center and adjacent to said heating roller and a second end portion adjacent to said heating roller;

a controller configured to control electric power supplied to said excitation coil so that a temperature of said heating roller is maintained at a target temperature which is lower than the Curie temperature; and a magnetic flux shielding plate provided so as to oppose said excitation coil through said heating roller and configured to shield the magnetic flux when said heating roller is heated up to a temperature higher than the Curie temperature, said magnetic flux shielding plate being made of a non-magnetic metal having a resistivity smaller than that of said magnetism-adjusted alloy, and being stationary relative to said heating roller, wherein said magnetic flux shielding plate is disposed within an angular range between a first angular position in which said first end portion is positioned and a second angular position in which said second end portion is positioned and excluding the first angular position and the second angular position, and wherein a length of said magnetic flux shielding plate is the same or larger than a half length of the angular range, in a rotational direction of said heating roller.

9. An apparatus according to claim 8, wherein said controller controls the electric power such that a skin depth of said electroconductive layer when the temperature of said heating roller is lower than the Curie temperature is smaller than a thickness of said electroconductive layer, and the skin depth when the temperature of said heating roller is higher than the Curie temperature is larger than the thickness of said electroconductive layer.

10. An apparatus according to claim 8, wherein said magnetic flux shielding plate has an arcuate configuration substantially concentric with said heating roller.

11. An apparatus according to claim 8, further comprising a rotary member configured to form a nip portion in which the sheet is nipped and conveyed cooperatively with said heating roller.

12. An apparatus according to claim 8, wherein said magnetism-adjusted alloy comprises iron, nickel, chrome, and said magnetic flux shielding plate is a copper plate.

* * * * *